US008296978B2

(12) United States Patent
Stewart

(10) Patent No.: US 8,296,978 B2
(45) Date of Patent: Oct. 30, 2012

(54) PERIMETRICALLY TENSIONED FLEXIBLE SIGNAGE MOUNT

(76) Inventor: Glen Stewart, Blaine, WA (US)

( * ) Notice: Subject to any disclaimer, the term of this patent is extended or adjusted under 35 U.S.C. 154(b) by 100 days.

(21) Appl. No.: 12/739,927

(22) PCT Filed: Oct. 27, 2008

(86) PCT No.: PCT/US2008/012169

§ 371 (c)(1),
(2), (4) Date: Aug. 25, 2010

(87) PCT Pub. No.: WO2009/055064

PCT Pub. Date: Apr. 30, 2009

(65) Prior Publication Data

US 2011/0023341 A1 Feb. 3, 2011

Related U.S. Application Data

(60) Provisional application No. 61/064,926, filed on Apr. 3, 2008, provisional application No. 60/996,038, filed on Oct. 25, 2007.

(51) Int. Cl.
*G09F 21/04* (2006.01)

(52) U.S. Cl. ..... 40/590; 40/600; 40/603

(58) Field of Classification Search ..... 40/588–591, 40/603, 604; 160/328, 629, 354, 368.1; 38/102–102.91

See application file for complete search history.

(56) References Cited

U.S. PATENT DOCUMENTS

| | | | |
|---|---|---|---|
| 3,372,503 | A | 3/1968 | Weeks |
| 3,958,350 | A | 5/1976 | Garson |
| 4,287,676 | A | 9/1981 | Weinhaus |
| 5,058,299 | A | 10/1991 | Suzuki |
| 5,142,804 | A | 9/1992 | Hillstrom et al. |
| 5,239,765 | A | 8/1993 | Opdahl |
| 5,415,451 | A | 5/1995 | Stanton |
| 5,507,109 | A | 4/1996 | Rinzler |
| 5,609,317 | A | 3/1997 | Glynn et al. |
| 5,664,354 | A | 9/1997 | Daviau et al. |
| 5,845,423 | A | 12/1998 | Hicks |
| 6,041,535 | A | 3/2000 | Holloway et al. |
| 6,092,319 | A | 7/2000 | Hicks |
| 6,101,751 | A | 8/2000 | Hicks |

(Continued)

FOREIGN PATENT DOCUMENTS

CA 2193433 5/2006

OTHER PUBLICATIONS

International Search Report for International Application No. PCT/US08/12169 (2 pages).

(Continued)

*Primary Examiner* — Lesley D Morris
*Assistant Examiner* — Shin Kim
(74) *Attorney, Agent, or Firm* — McDermott Will & Emery, LLP

(57) ABSTRACT

The invention provides systems for removably attaching flexible signage to transportable containers, including systems adapted for attaching advertising banners to truck trailers. An aspect of the invention is a support line length adjustment mechanism adapted to be actuated to alternatively shorten and tension a signage sheet support line, and to lengthen and thereby untension the support line, to release the support line and the signage from the container.

17 Claims, 30 Drawing Sheets

U.S. PATENT DOCUMENTS

| | | | | |
|---|---|---|---|---|
| 6,167,649 | B1 | 1/2001 | Palmeri | |
| 6,250,002 | B1 | 6/2001 | Wittenberg | |
| 6,282,822 | B1 | 9/2001 | Rinzler et al. | |
| 6,339,889 | B1 * | 1/2002 | Griesemer et al. | 40/603 |
| 6,393,746 | B1 | 5/2002 | Jacobson | |
| 6,513,272 | B2 | 2/2003 | Richards et al. | |
| 6,530,165 | B2 | 3/2003 | Griesemer et al. | |
| 6,574,895 | B2 | 6/2003 | Nestor et al. | |
| 6,684,542 | B2 | 2/2004 | Green, III et al. | |
| 6,718,668 | B2 | 4/2004 | Cozzilino | |
| 6,760,990 | B2 | 7/2004 | Lowndes | |
| 6,769,726 | B1 | 8/2004 | Clark | |
| 6,904,709 | B2 | 6/2005 | Craig et al. | |
| 7,051,465 | B2 * | 5/2006 | Slesinski et al. | 40/590 |
| 7,117,620 | B2 * | 10/2006 | Tolna | 40/601 |
| 7,124,525 | B2 | 10/2006 | Green, III et al. | |
| 7,159,349 | B2 | 1/2007 | Uccello et al. | |
| 7,213,356 | B2 | 5/2007 | Haggard, Jr. | |
| 2001/0054244 | A1 | 12/2001 | Richards | |
| 2002/0116307 | A1 | 8/2002 | Britten | |
| 2003/0200685 | A1 | 10/2003 | Gibb | |
| 2004/0134108 | A1 | 7/2004 | Harari | |
| 2004/0205992 | A1 | 10/2004 | Devaney | |
| 2005/0178033 | A1 | 8/2005 | Elmer | |
| 2006/0143958 | A1 | 7/2006 | Gerrits | |
| 2007/0044359 | A1 * | 3/2007 | Worley | 40/590 |
| 2007/0056200 | A1 * | 3/2007 | Ridless | 40/603 |
| 2007/0113448 | A1 | 5/2007 | Andrews | |

OTHER PUBLICATIONS

International Preliminary Report on Patentability for International Application No. PCT/US08/12169 (6 pages).

* cited by examiner

PERIMETRICALLY TENSIONED FLEXIBLE SIGNAGE MOUNT

FIELD OF THE INVENTION

The invention is in the field of systems for removably attaching flexible signage to transportable containers.

BACKGROUND OF THE INVENTION

A wide variety of systems have been used to releasably attach signage to structures, including truck trailers. For example, U.S. Pat. No. 5,664,354 discloses an elegant system of cams for tensioning the border of a sign placed on a truck trailer. The choice of tensioning mechanisms for use in such devices has been the subject of significant ingenuity, as evidenced by the systems disclosed in the following documents: U.S. Pat. No. 6,167,649; US Patent Publication No. 2003/0200685; 2007/0113448; 2004/0205992; U.S. Pat. No. 6,393,746; U.S. Pat. No. 6,250,002; U.S. Pat. No. 6,574,895; U.S. Pat. No. 5,239,765; U.S. Pat. No. 5,507,109; U.S. Pat. No. 5,058,299; and U.S. Pat. No. 7,213,356.

Truck advertising of the kind discussed above may be useful in sophisticated advertising systems, such as the advertising methods described in US Patent Publication 2002/0116307.

SUMMARY OF THE INVENTION

In selected embodiments, the invention provides a system for removably mounting signage on transportable containers. As such, the system of the invention is adapted to meet two countervailing requirements. On the one hand, the system is adapted so that the signage may be relatively easily removed from the container, for example to permit access to the interior of the container through a door covered by the signage. On the other hand, the system is adapted so that the attachment of the signage to the container is sufficiently robust to ensure that the signage is not easily displaced during movement of the container, so that it does not, for example, easily blow off the back of moving transport trailer.

Accordingly, the invention provides signage mounting systems, such as systems adapted for use on movable containers. These containers may be, for example, truck trailers, truck boxes or shipping cargo containers, typically having an interior and an exterior, and adapted to house material in the interior of the container for transport. Containers generally have one or more access doors, often including rear doors, that provide an opening into the container, the doors generally being closable for transport of the container, so that the door has an open position and a closed position. In one aspect, the invention provides a signage mounting system adapted to be mounted over container doors, or a portion thereof, and to be removable, to facilitate opening the access doors for occasional access to the interior of the container.

Signage sheets of the invention may be flexible and, in most mounted configurations, will be generally flat or planar. The shape of the mounted sheet will conform to the exterior surface of the container to which it is removably mounted. Flat sheets may be mounted against flat container walls or doors, so that the sheet is in juxtaposed parallel planar arrangement with, and covering, the external container surface. As such, the signage sheet will have an interior sheet surface, facing the external container surface, and an opposing exterior sheet surface facing away from the external container surface. The exterior surface of the signage sheet will generally present the visible face of the signage, bearing visible symbols such as advertising indicia.

A variable length tensionable support line, such as a wire rope, may be perimetrically attached to the signage sheet, at various points along the perimeter of the sheet. The catches for the support line are arranged on the container, and the signage sheet is sized, so that when the support line is drawn taught, or tensioned, it will draw the signage sheet tight over the external container surface. In this way, the mounting systems of the invention provides for a significant degree of flexibility in sizing the signage sheet, because the variable length of the tensionable support line is adaptable to accommodate signs of virtually any shape that falls within the perimeter defined by the support line.

A plurality of support line catches, such as anchored pulleys, are attached to the container. The catches removably engage the support line, so as to hold the support line and the signage sheet on the container when the support line is in a tensioned state, and so that the catches release the support line and the signage sheet from the container when the support line is in an untensioned state. The number and position of the support line catches will determine the range of mounting positions available for the signage sheet.

A support line length adjustment mechanism, such as a ratchet winch, may be adapted to be actuated to alternatively shorten or lengthen the support line. Shortening the support line, with the support line engaging the catches, tensions the support line on the catches, so that the support line is in a tensioned state fixing the support line on the catches. Lengthening the support line releases the tension on the support line, so that the support line is in an untensioned state, eventually releasing the support line from engagement with the catches.

DETAILED DESCRIPTION OF THE INVENTION

In broad aspects, the invention provides signage mounting systems for removably attaching signage to a surface. In selected embodiments, the surface is on a movable container, such as the truck trailer containing rear access roll up doors shown in FIG. 1. In general, the signage itself is meant for only temporary display, while other components of the system are intended to be durable and adaptable for use with successive generations of signage, including signage of alternative dimensions. In particular, support line 18 and support line catches 12 used in various embodiments may be robust and durable, while being arranged for facile adaptation for mounting flexible signage of alternative dimensions.

Figure 1:
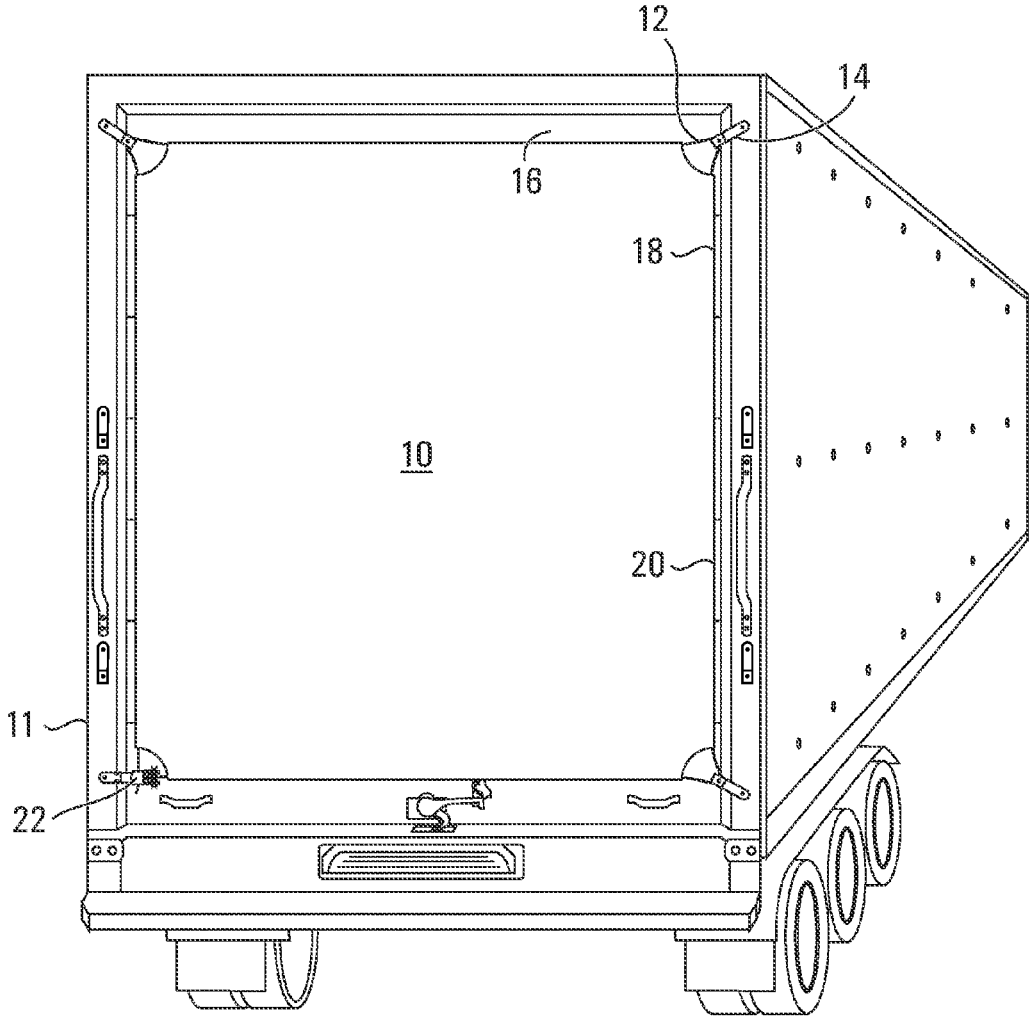
FIG. 1 is a perspective view of a truck trailer with rear access roll up doors which shows flexible signage of the invention mounted on the rear thereof, across the rear access roll up doors.
Figure 12:
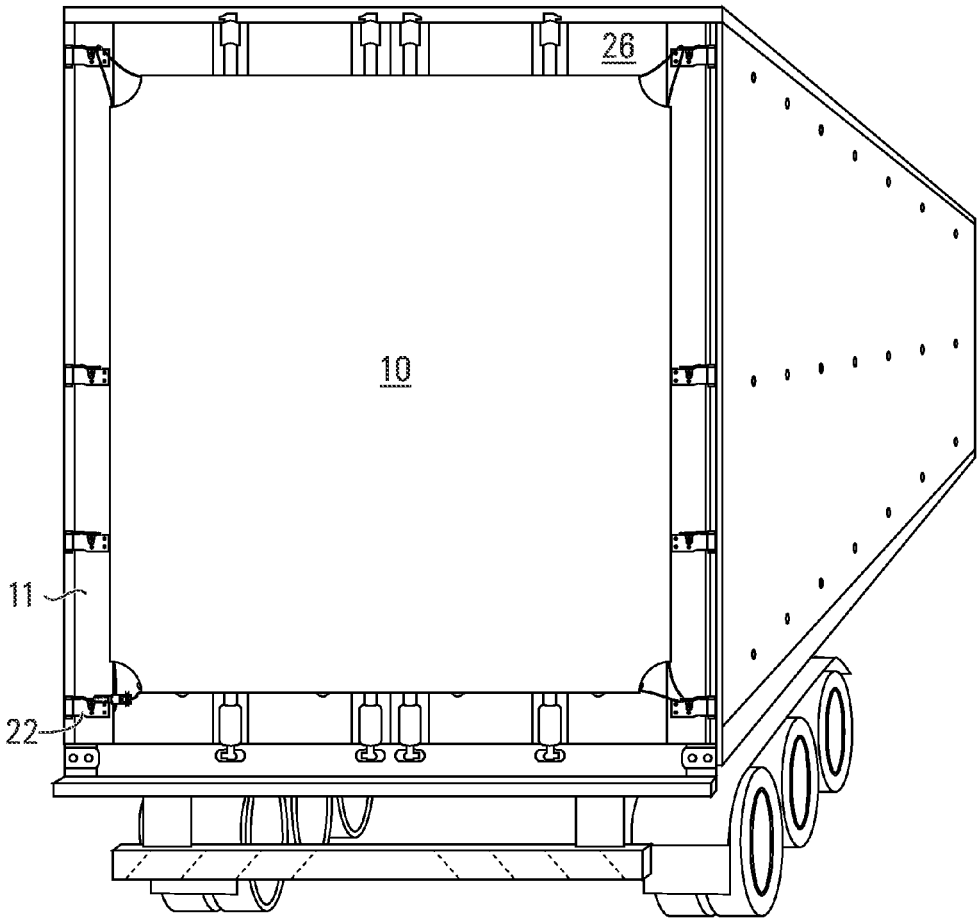
FIG. 12 is a perspective view of a truck trailer with rear access swing doors which shows flexible signage of the invention mounted on the rear thereof, across the rear access swing doors.
Figure 13:
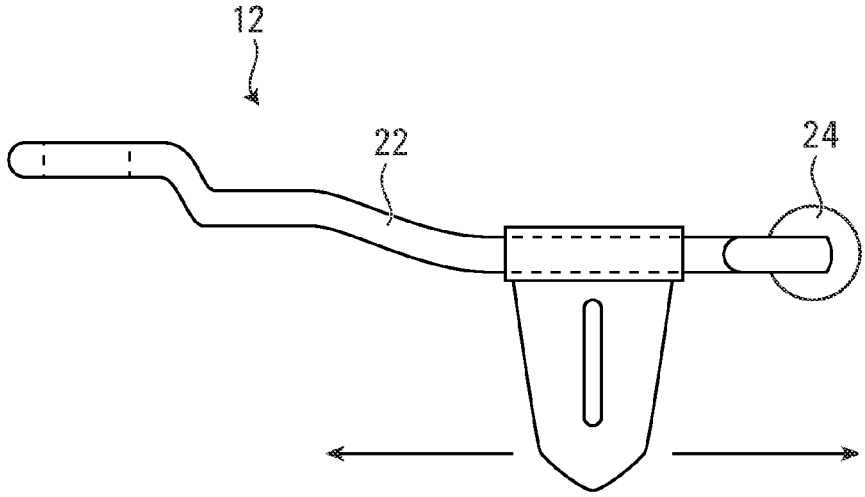
FIG. 13 is an isometric elevational side view of a support line catch of the invention.
Figure 14:
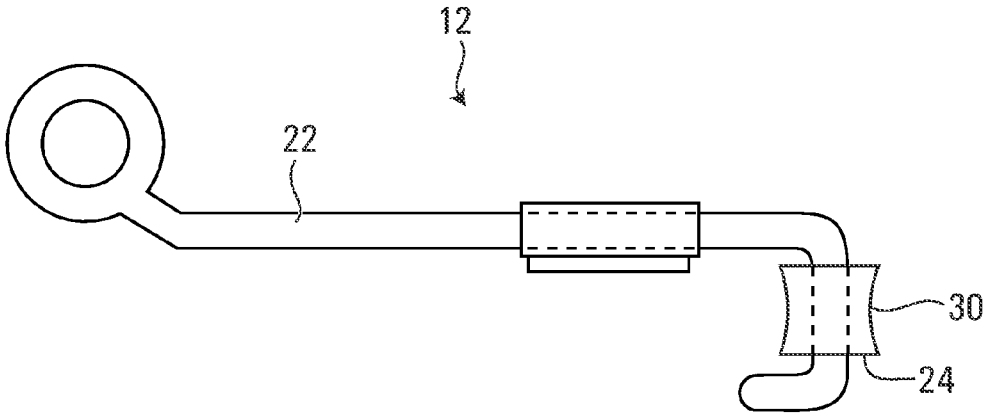
FIG. 14 is an isometric rear plan view of the support line catch of FIG. 13.
Figure 15:
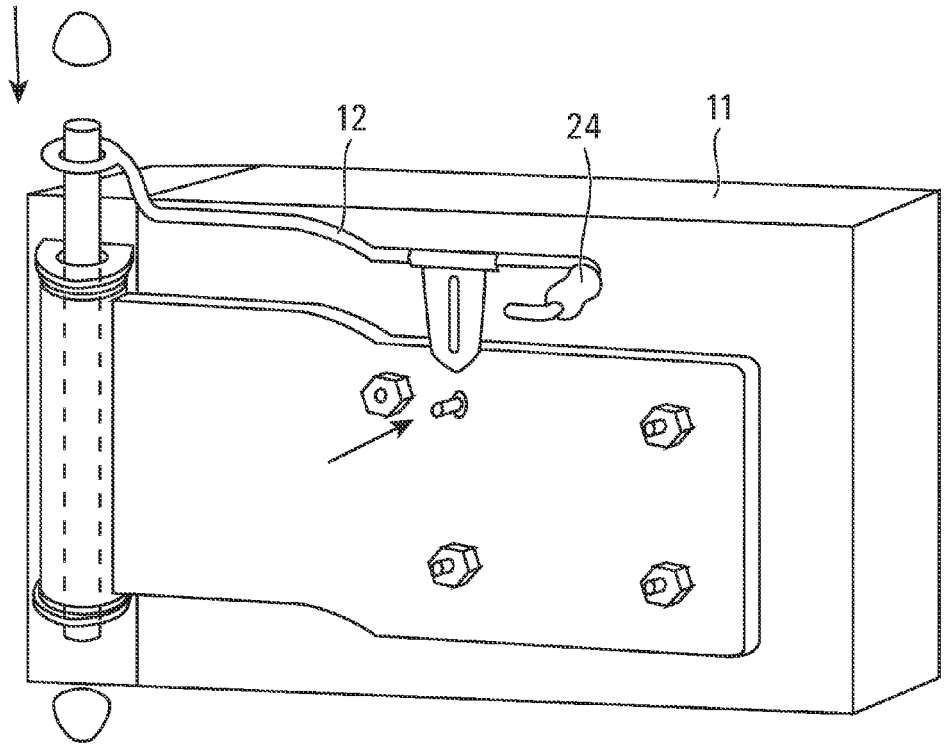
FIG. 15 is a perspective view of an embodiment of the support line catch of FIG. 13 showing the support line catch in association with a mounting prior to installation.
Figure 16:
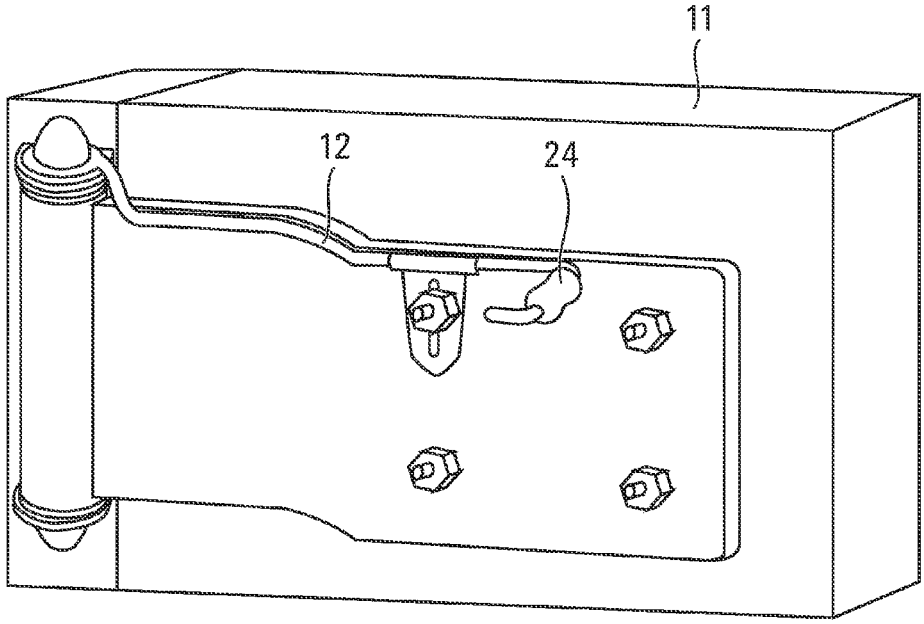
FIG. 16 is a perspective view of an embodiment of the support line catch as described in FIG. 15 following installation.
Figure 17:
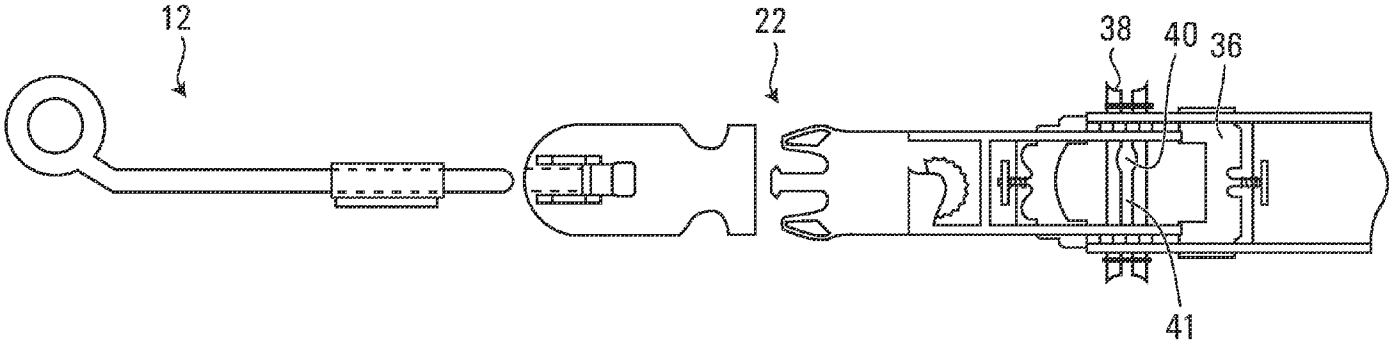
FIG. 17 is an isometric front view of a ratchet winch support line tensioning mechanism.
Figure 18:
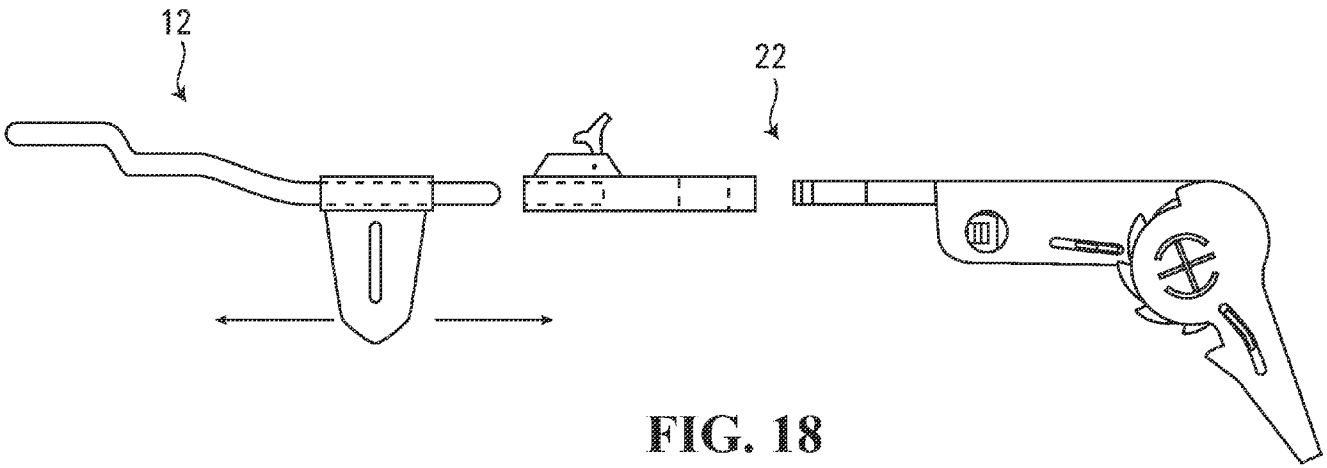
FIG. 18 is an elevational side view of the ratchet winch support line tensioning mechanism of FIG. 17.
Figure 19:
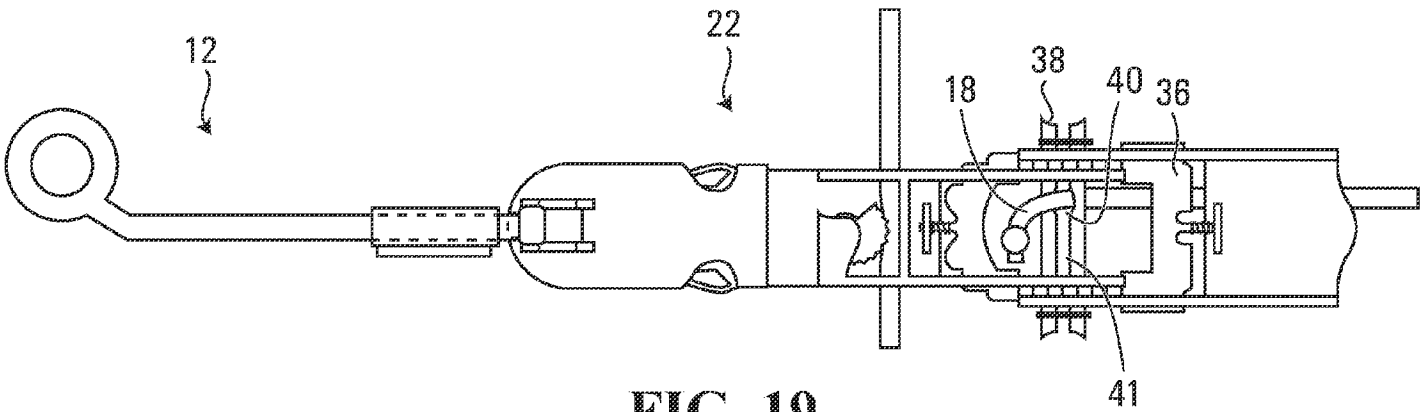
FIG. 19 is an isometric front view of the ratchet winch support line tensioning mechanism of FIG. 17 in association with vertical and horizontal cables.
Figure 20:
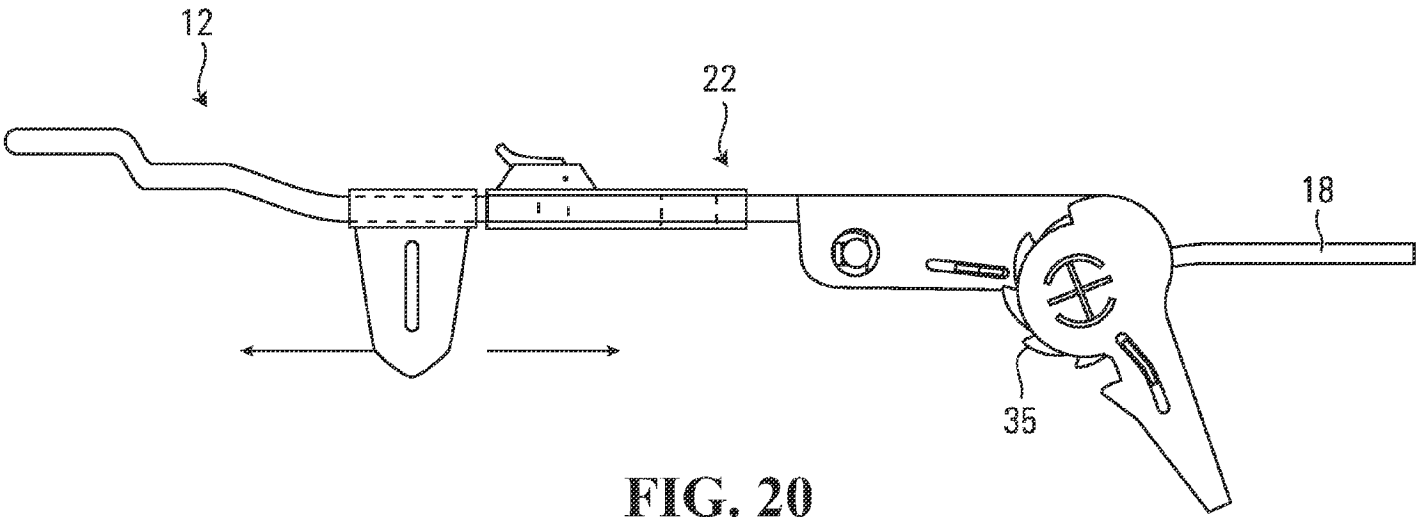
FIG. 20 is an elevational side view of the ratchet winch support line tensioning mechanism of FIG. 17 in association with vertical and horizontal cables.
Figure 21:
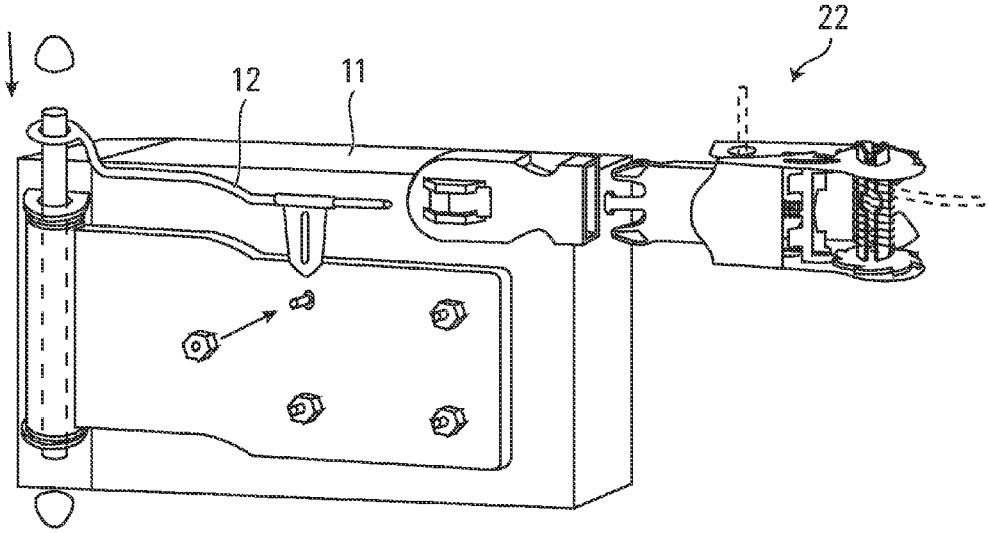
FIG. 21 is a perspective view of the ratchet winch support line tensioning mechanism of FIG. 17 in association with vertical and horizontal cables prior to installation.
Figure 22:
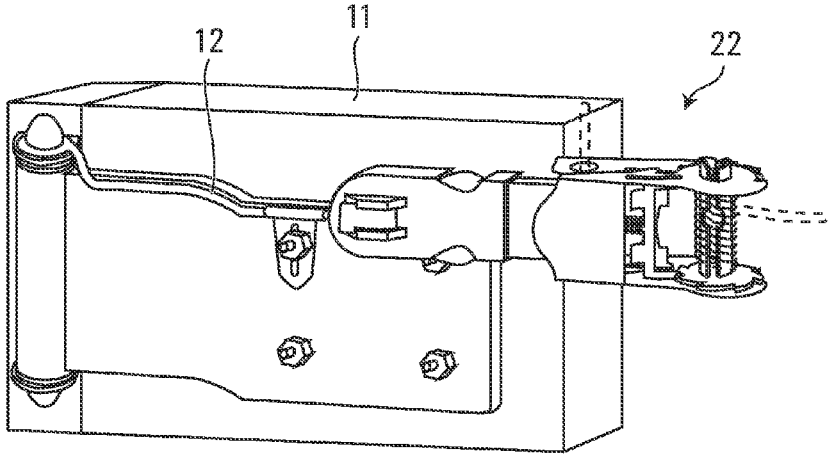
FIG. 22 is a perspective view of the ratchet winch support line tensioning mechanism of FIG. 17 in association with vertical and horizontal cables following installation.
Figure 23:
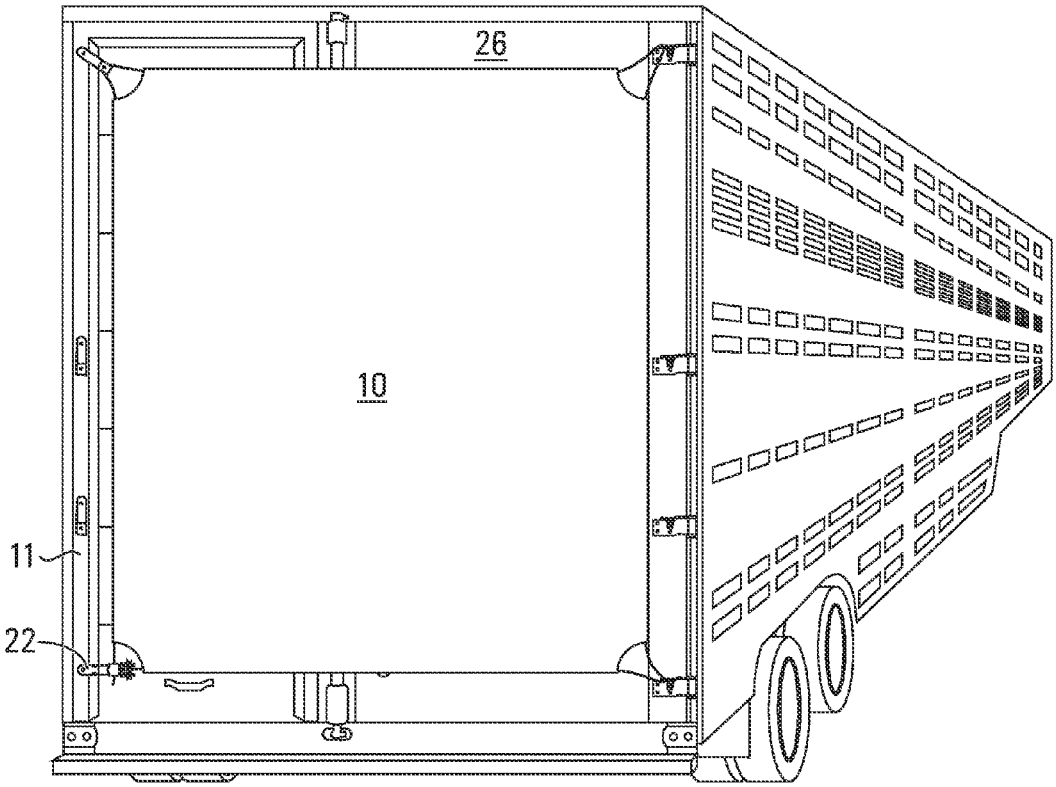
FIG. 23 is a perspective view of a cattle hauler-style truck trailer with rear access swing doors which shows flexible signage of the invention mounted on the rear thereof, across the rear access swing doors.
Figure 24:
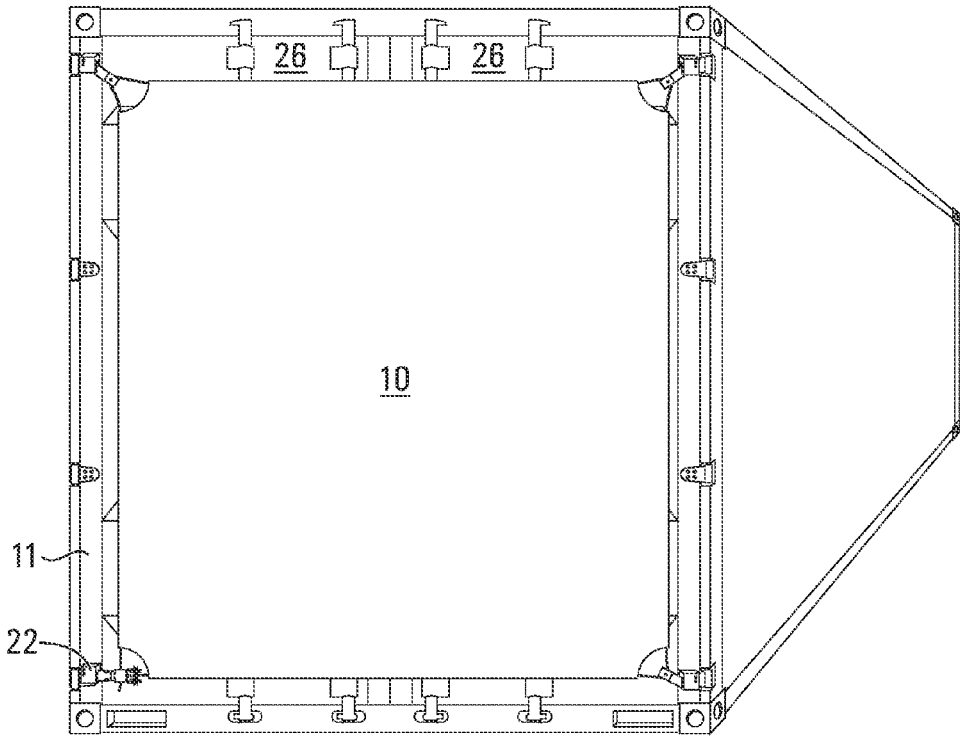
FIG. 24 is a perspective view of a cargo container with rear access swing doors which shows flexible signage of the invention mounted on the rear thereof, across the rear access swing doors.
Figure 25:
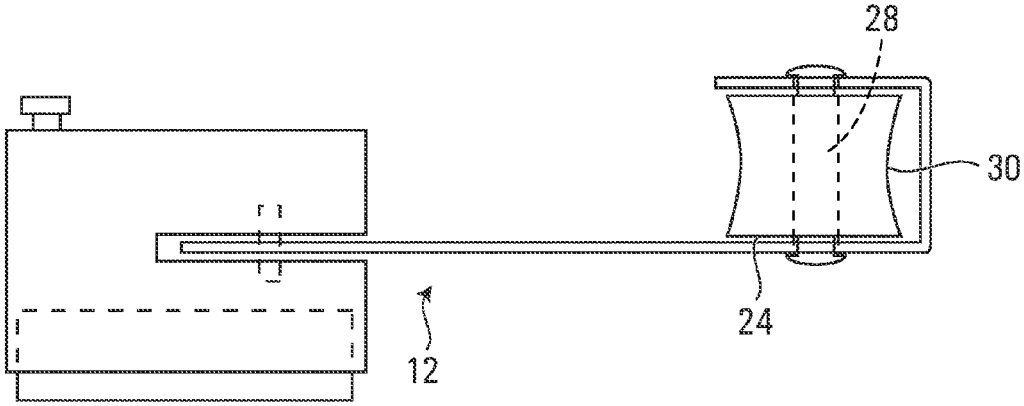
FIG. 25 is an isometric elevational side view of a support line catch of the invention.
Figure 26:
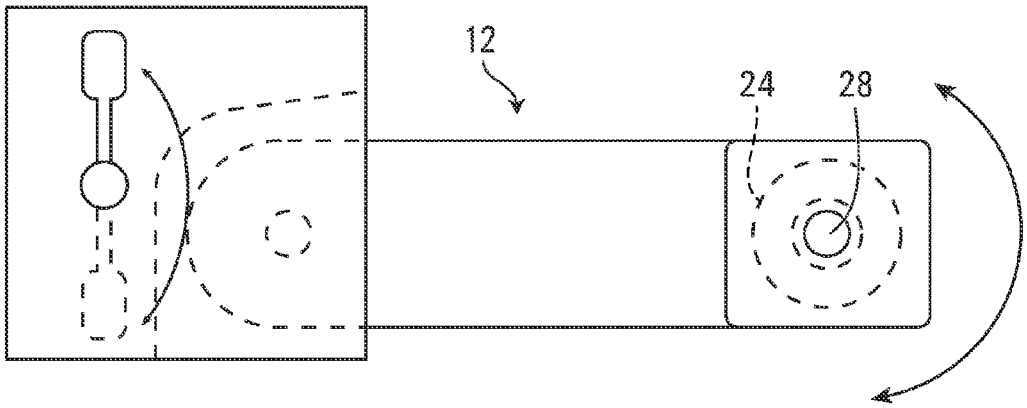
FIG. 26 is an isometric rear plan view of the support line catch of FIG. 25.
Figure 27:
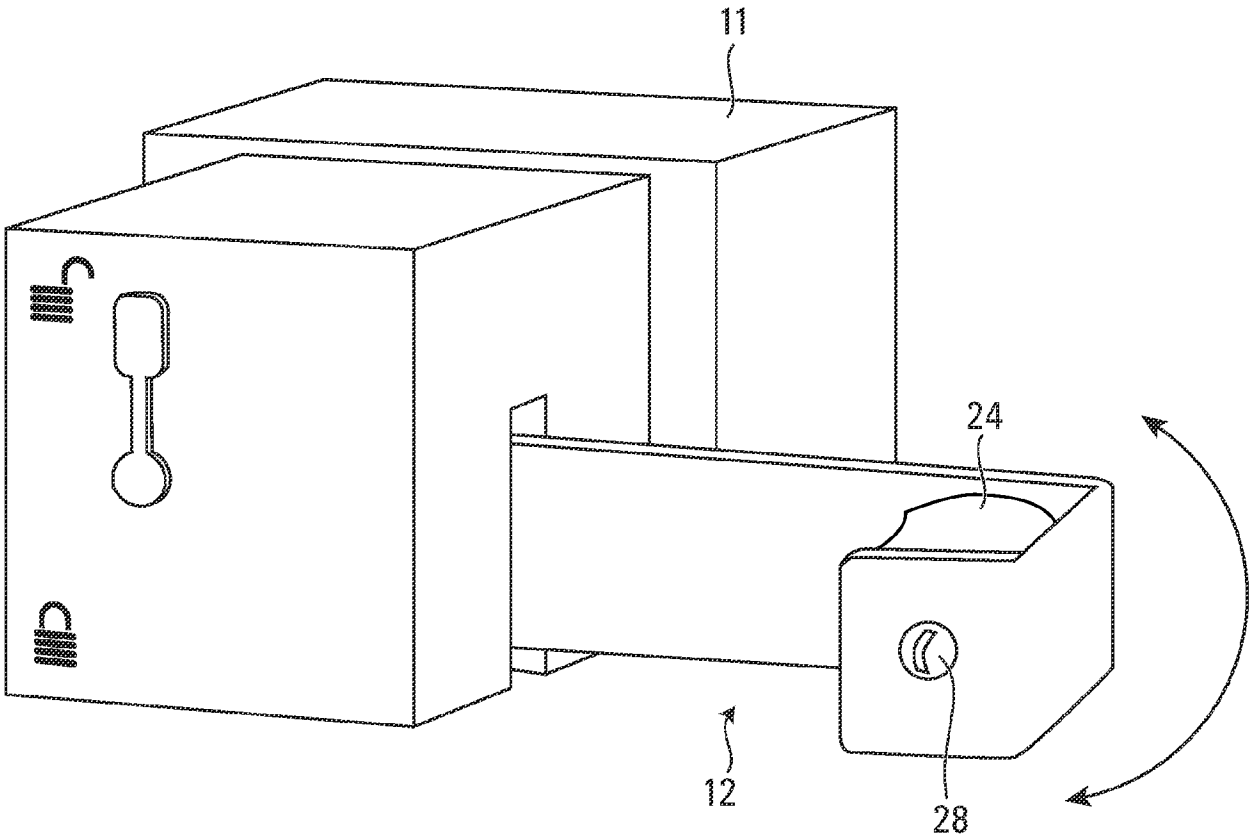
FIG. 27 is a perspective view of an embodiment of the support line catch of FIG. 25.
Figure 28:
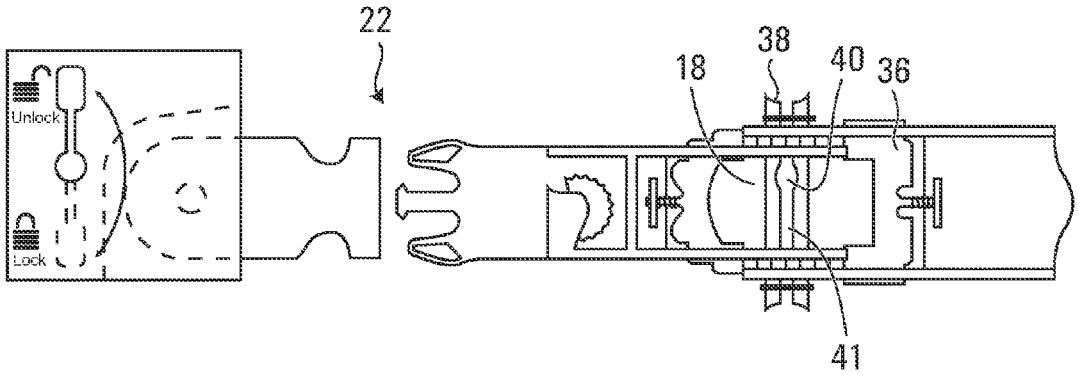
FIG. 28 is an isometric front view of a ratchet winch support line tensioning mechanism.
Figure 29:
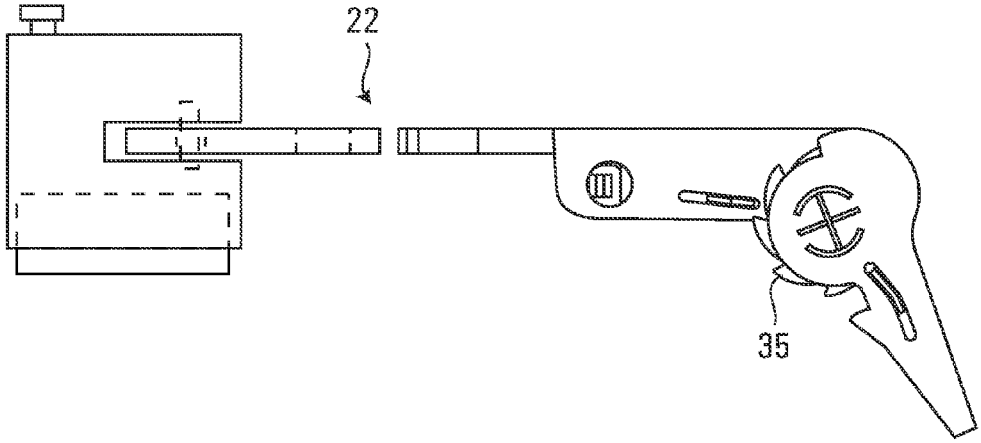
FIG. 29 is an elevational side view of the ratchet winch support line tensioning mechanism of FIG. 28.
Figure 30:
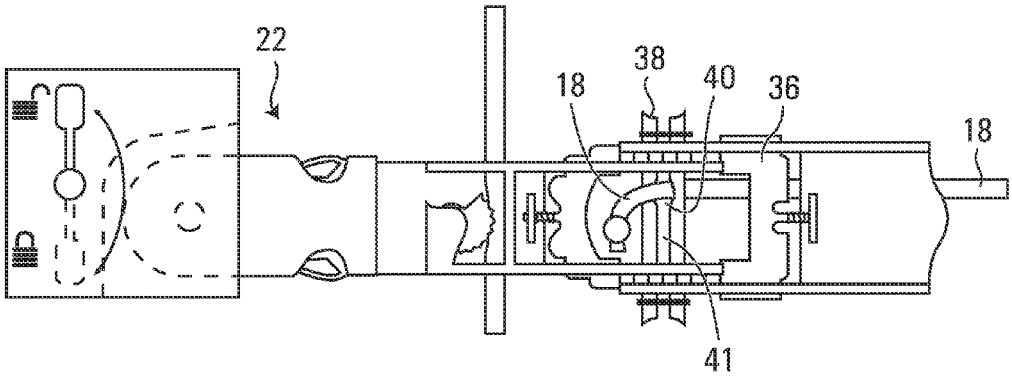
FIG. 30 is an isometric front view of the ratchet winch support line tensioning mechanism of FIG. 28 in association with vertical and horizontal cables.
Figure 31:
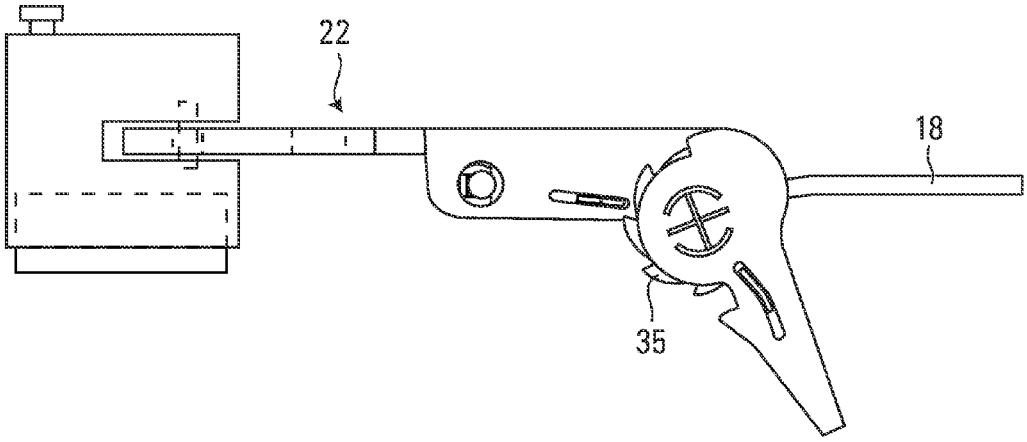
FIG. 31 is an elevational side view of the ratchet winch support line tensioning mechanism of FIG. 28 in association with vertical and horizontal cables.
Figure 32:
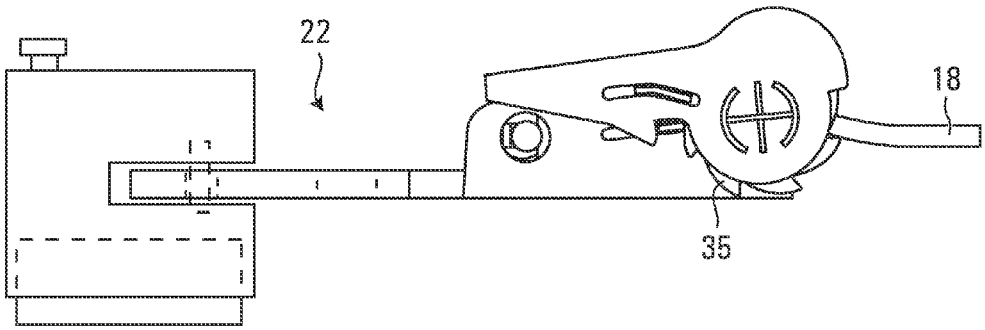
FIG. 32 is an isometric elevational side view of the ratchet winch support line tensioning mechanism of FIG. 28 in association with vertical and horizontal cables.
Figure 33:
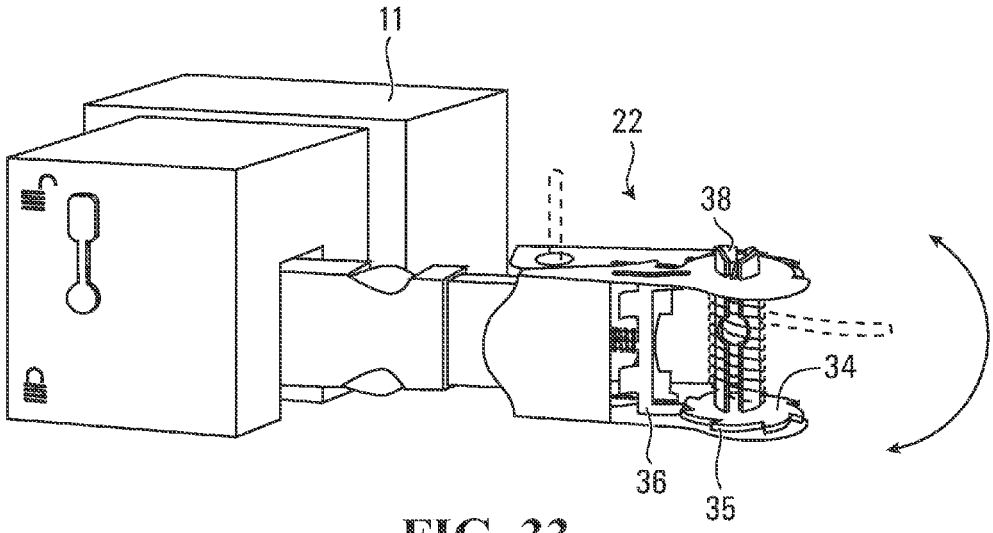
FIG. 33 is a perspective view of the ratchet winch support line tensioning mechanism of FIG. 28 in association with vertical and horizontal cables.
Figure 34:
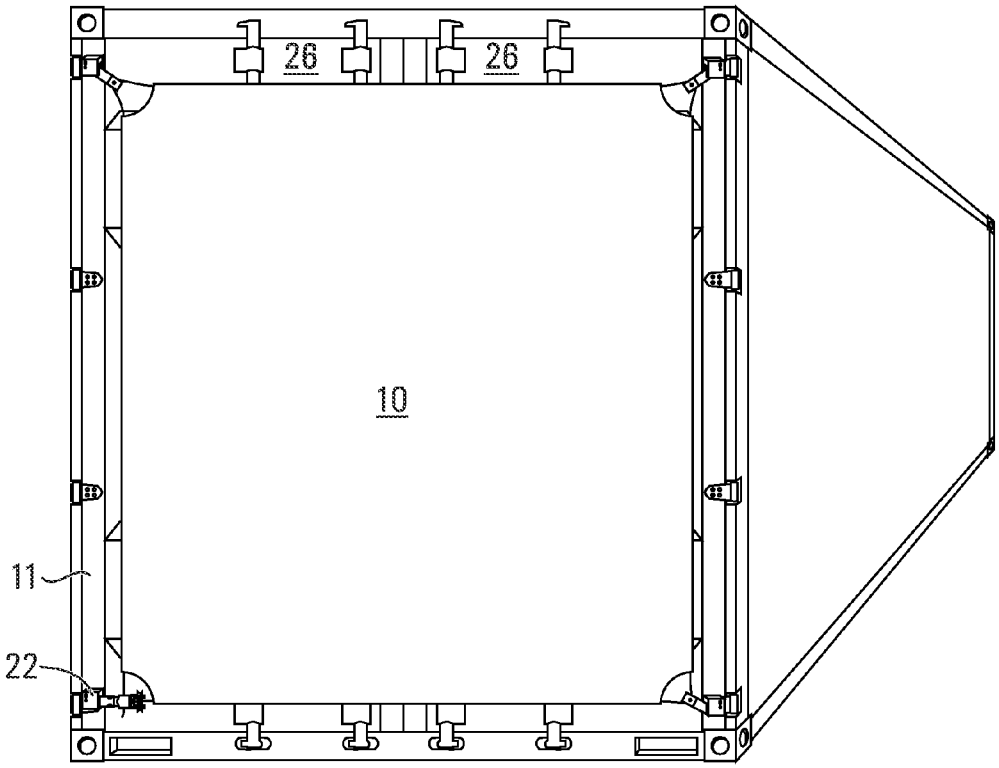
FIG. 34 is a perspective view of the cargo container described in FIG. 24 showing a magnetic retainer embodiment of the invention mounted on the rear thereof, across substantially all of the surface area of the rear access swing doors.
Figure 35:
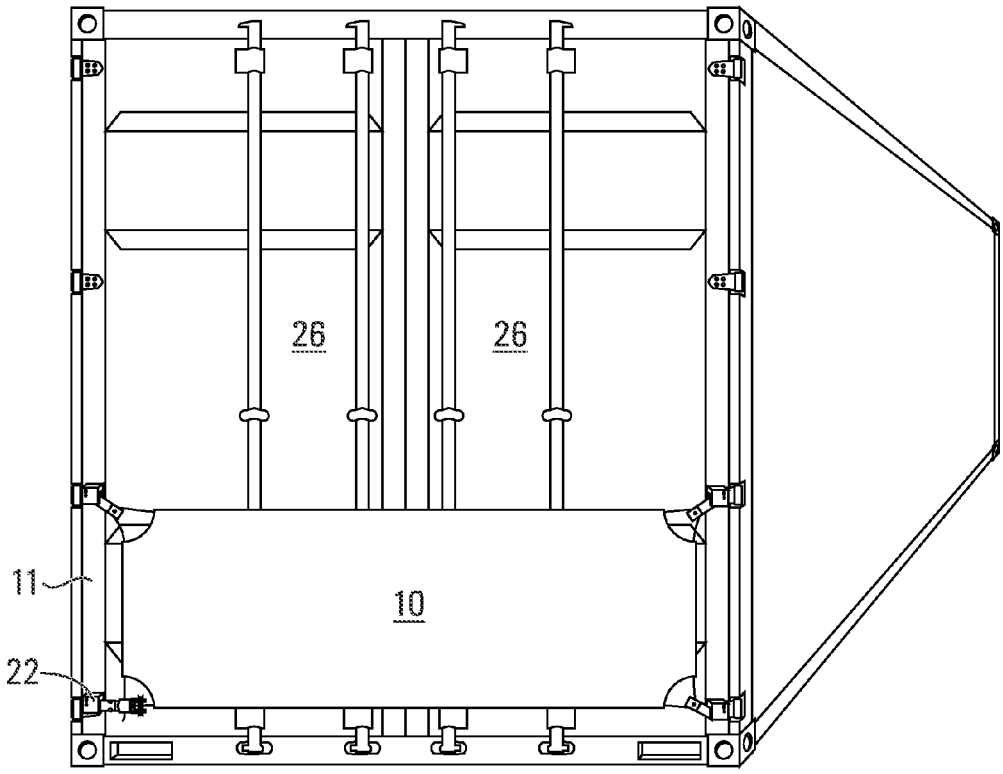
FIG. 35 is a perspective view of the cargo container described in FIG. 24 showing a magnetic retainer embodiment of the invention mounted on the rear thereof, across approximately one-half of the surface area of the rear access swing doors.
Figure 36:
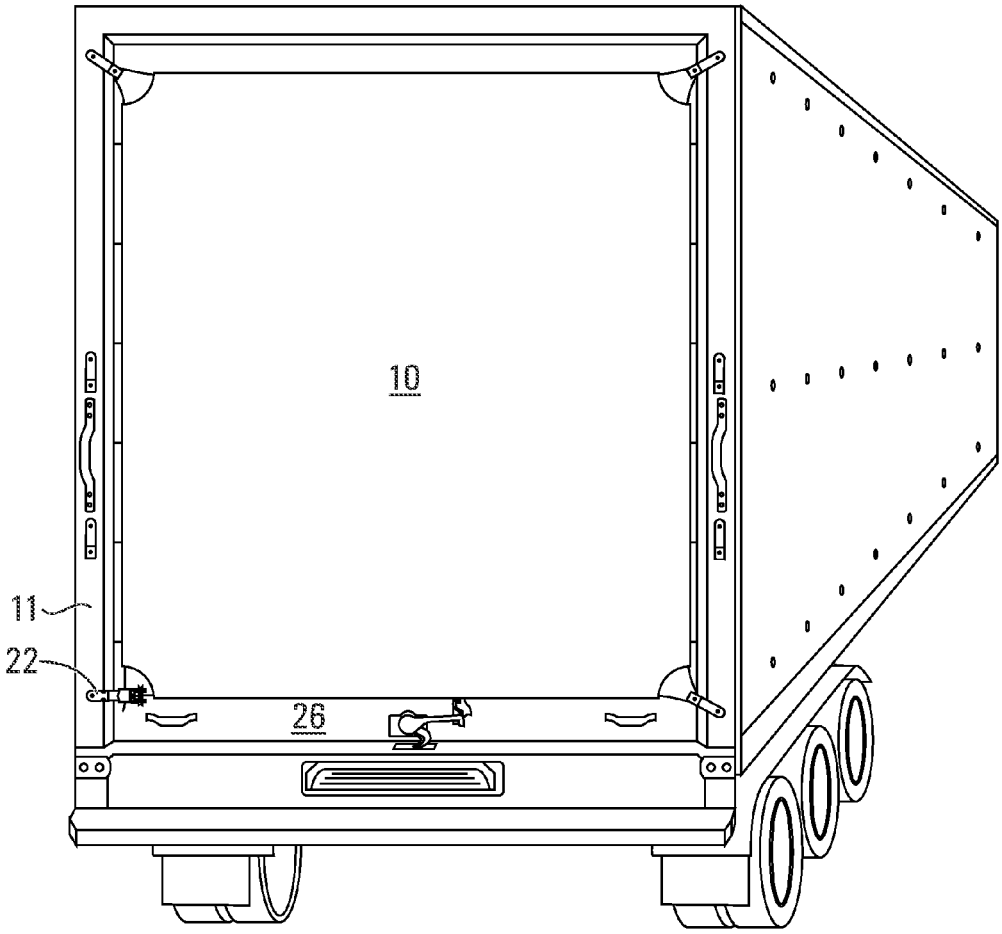
FIG. 36 is a perspective view of the truck trailer with rear access roll up doors described in FIG. 1 showing flexible signage of the invention mounted on the rear thereof, across substantially all of the surface area of the rear access roll up doors.
Figure 37:
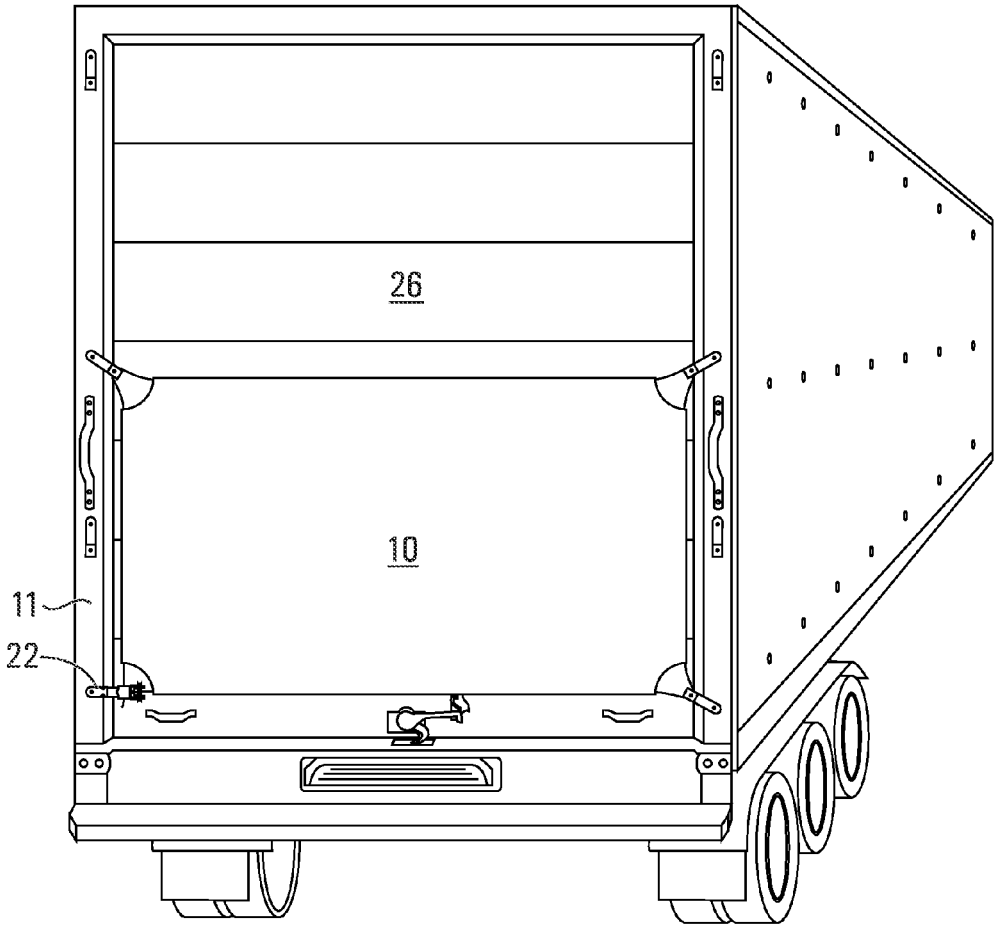
FIG. 37 is a perspective view of the truck trailer with rear access roll up doors described in FIG. 1 showing flexible signage of the invention mounted on the rear thereof, across approximately three-quarters of the surface area of the rear access roll up doors.
Figure 38:
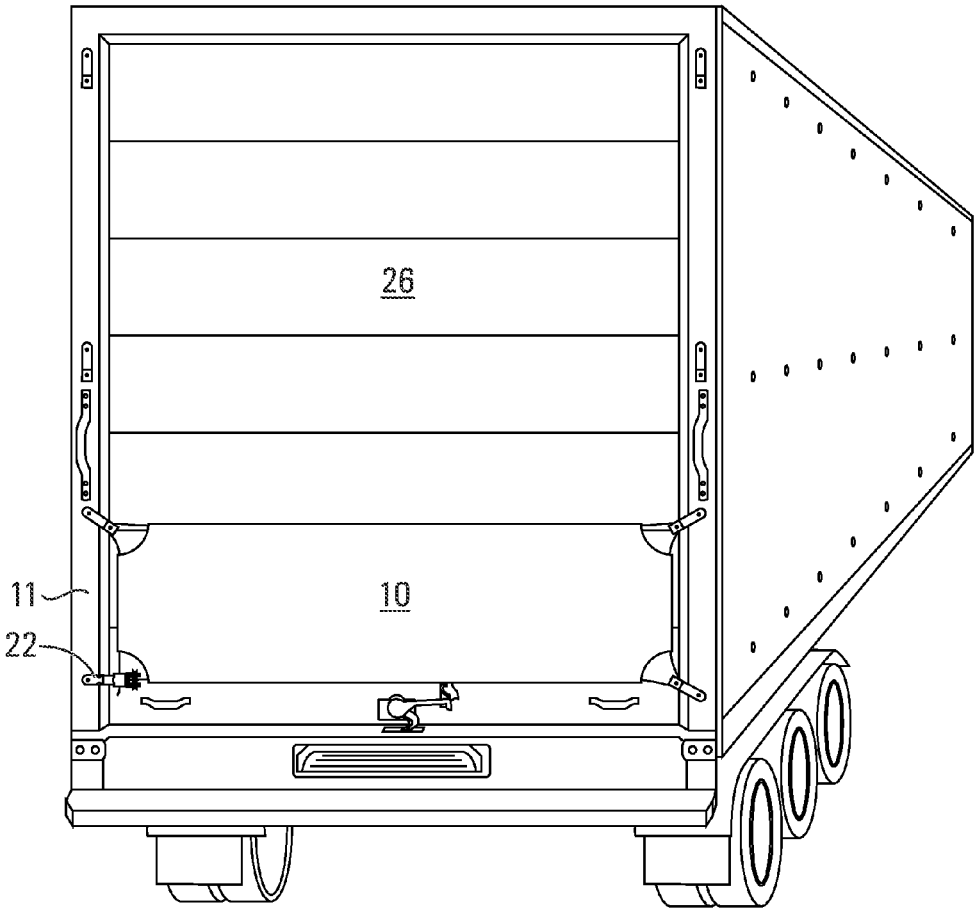
FIG. 38 is a perspective view of the truck trailer with rear access roll up doors described in FIG. 1 showing flexible signage of the invention mounted on the rear thereof, across approximately one-half of the surface area of the rear access roll up doors.
Figure 39:
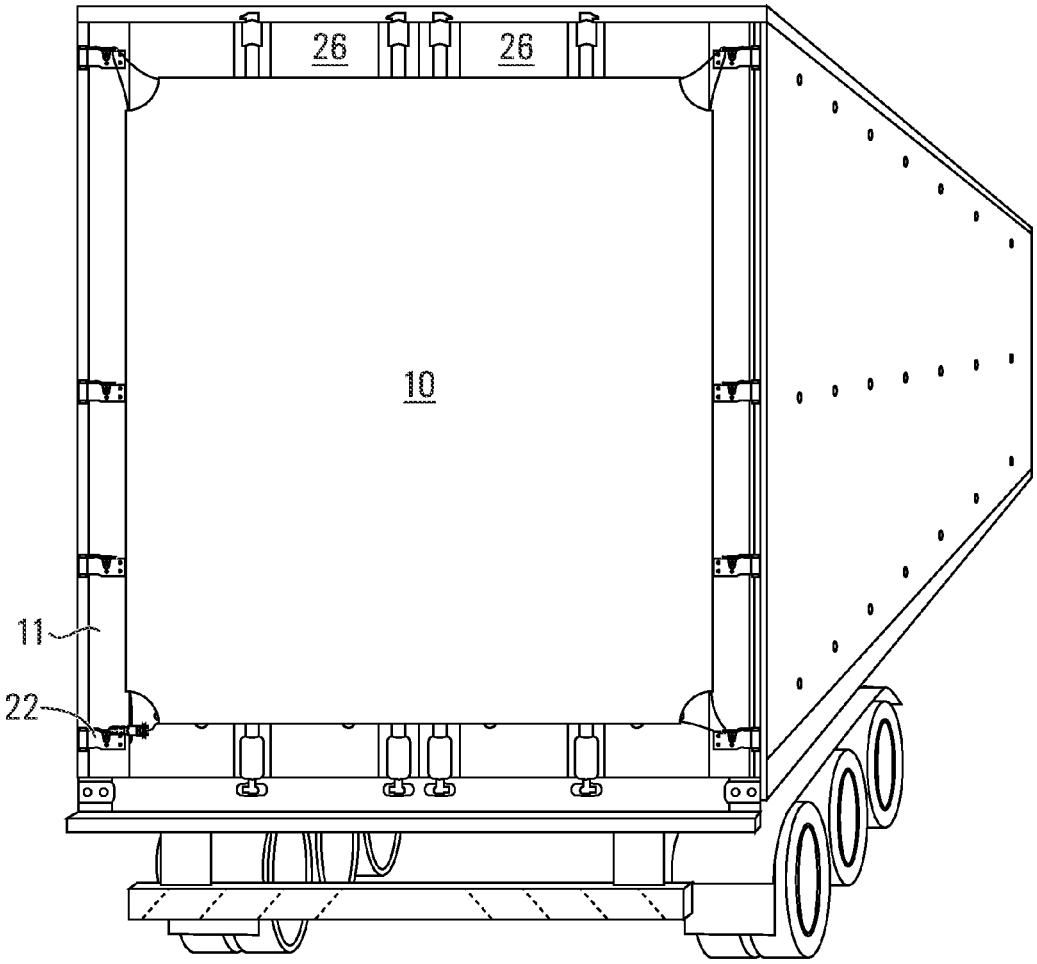
FIG. 39 is a perspective view of the truck trailer with rear access swing doors described in FIG. 12 showing flexible signage of the invention mounted on the rear thereof, across substantially all of the surface area of the rear access swing doors.
Figure 40:
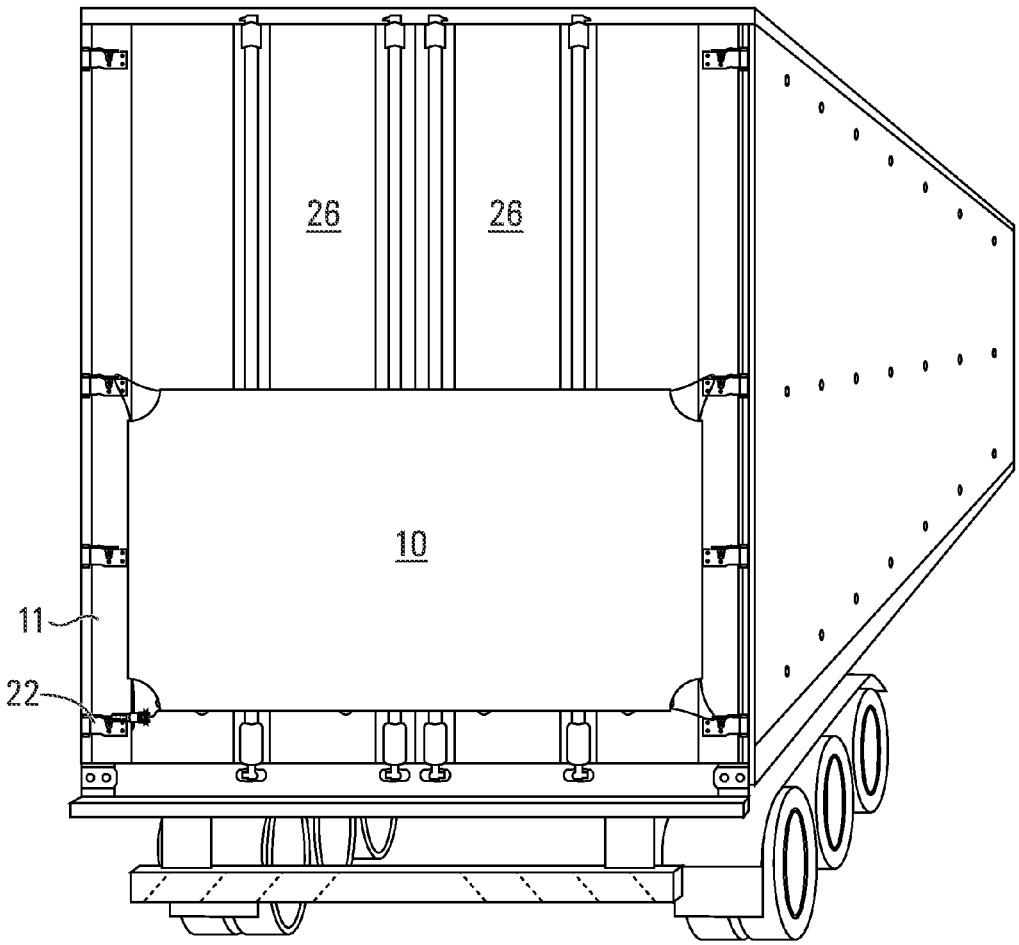
FIG. 40 is a perspective view of the truck trailer with rear access swing doors described in FIG. 12 showing flexible signage of the invention mounted on the rear thereof, across approximately three-quarters of the surface area of the rear access swing doors.
Figure 41:
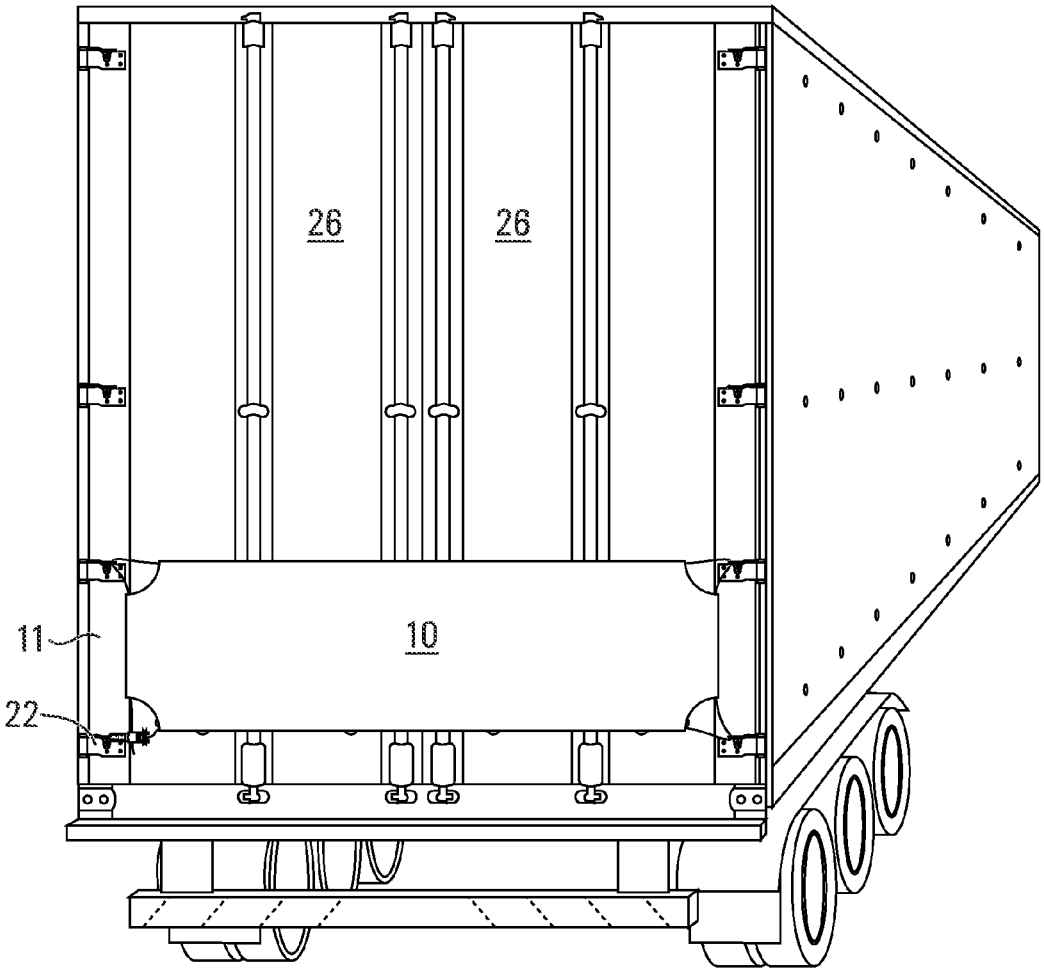
FIG. 41 is a perspective view of the truck trailer with rear access swing doors described in FIG. 12 showing flexible signage of the invention mounted on the rear thereof, across approximately one-half of the surface area of the rear access swing doors.
Figure 42:
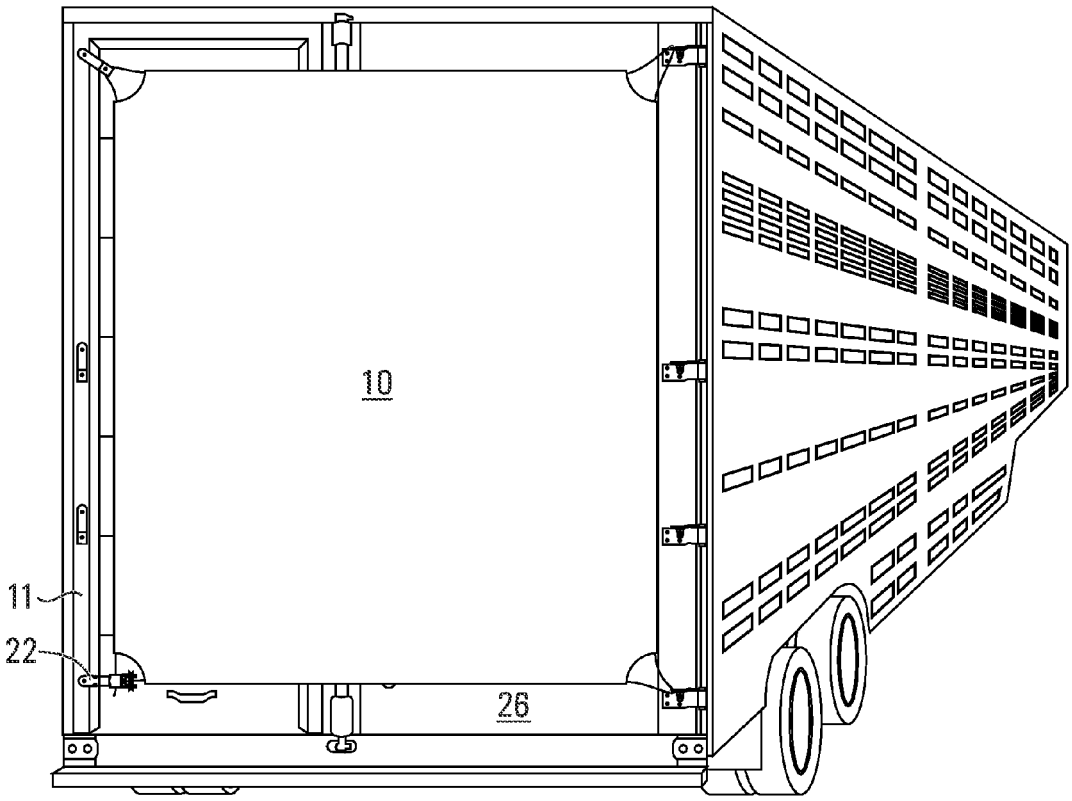
FIG. 42 is a perspective view of the cattle hauler-style truck trailer with rear access swing doors described in FIG. 23 showing flexible signage of the invention mounted on the rear thereof, across substantially all of the surface area of the rear access swing doors.
Figure 43:
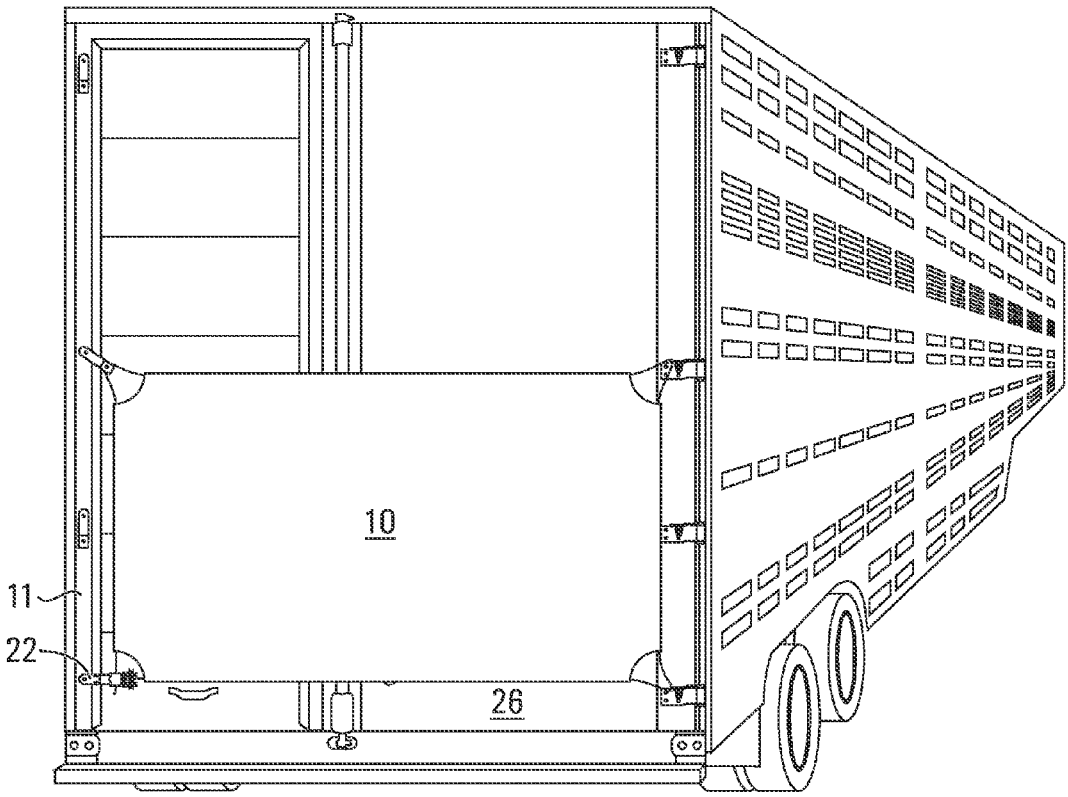
FIG. 43 is a perspective view of the cattle hauler-style truck trailer with rear access swing doors described in FIG. 23 showing flexible signage of the invention mounted on the rear thereof, across approximately three-quarters of the surface area of the rear access swing doors.
Figure 44:
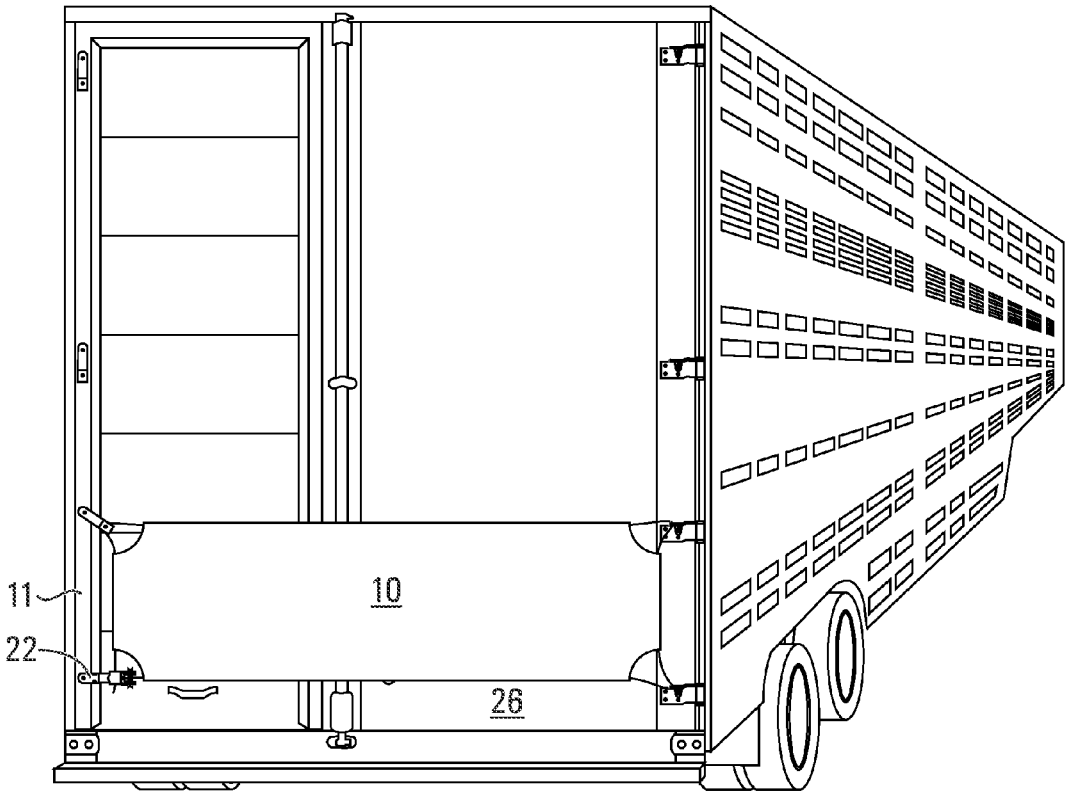
FIG. 44 is a perspective view of the cattle hauler-style truck trailer with rear access swing doors described in FIG. 23 showing flexible signage of the invention mounted on the rear thereof, across approximately one-half of the surface area of the rear access swing doors.

In selected embodiments, as shown in FIG. 1, support line catches 12 may be mounted to hinge plates 14 on the exterior surface of container 11. Alternately, as shown in FIG. 12, signage sheet 10 mounted over swinging container doors 26 prevents doors 26 from swinging open, so that components of the mounting system, including signage sheet 10, must be removed to facilitate opening the access doors on the container.

Signage sheet 10 of the invention may be flexible, to conform to the exterior surface of container 11. For example, mechanisms for locking access doors 16 often project from the planar surface of doors 16, and the mounting systems of the invention are adapted to afford signage sheet 10 a degree of flexibility in accommodating variations in the shape of the surface to which they are mounted. Flexible signage sheets may be made from a variety of natural and synthetic materials, such as canvas, polyesters or vinyl materials.

The visible exterior surface of the signage sheet may be selected so that it provides an appropriate surface on which to print visible symbols, such as advertising indicia, i.e., a printable surface. For example, dye sublimation printing or ink jet printing may be used to apply visible indicia to the exposed face of the signage sheet. Further, flexible responsive media signage may be used as the visible exterior surface of the signage sheet. In methods of the invention, alternative indicia may be printed in successive layers on a single signage sheet, to provide successive generations of signage sheets for use with a fixed mounting system comprising a support line catches 12 and support line length adjustment mechanism 22.

As shown in FIG. 1, support line 18 perimetrically supports signage sheet 10. Hemmed channels 20 along portions of the perimeter of signage sheet 10 form sleeves that accept support line 18, with support line 18 threaded through these perimetric supports, except at the apices of signage sheet 10, where support line 18 extends to engage support line catches 12 and support line length adjustment mechanism 22. Alternative forms of linking support line 18 to signage sheet 10 may be provided, in which support line 18 slidably engages the perimeter of signage sheet 10, permitting support line 18 to slide in the links to the signage sheet 10 as support line 18 is lengthened and shortened.

Support line catches 12 are arranged on container 11, and signage sheet 10 is sized, so that when support line 18 is drawn taught, or tensioned, it draws signage sheet 10 tight over the external container surface, for example formed by doors 16. The variable length of tensionable support line 18 may be adaptable to accommodate signs of virtually any shape that fall within the perimeter defined by support line 18 on catches 12. Accordingly, in such embodiments, the perimeter of signage sheet 10 falls within the perimeter defined by support line 18.

Figure 2:
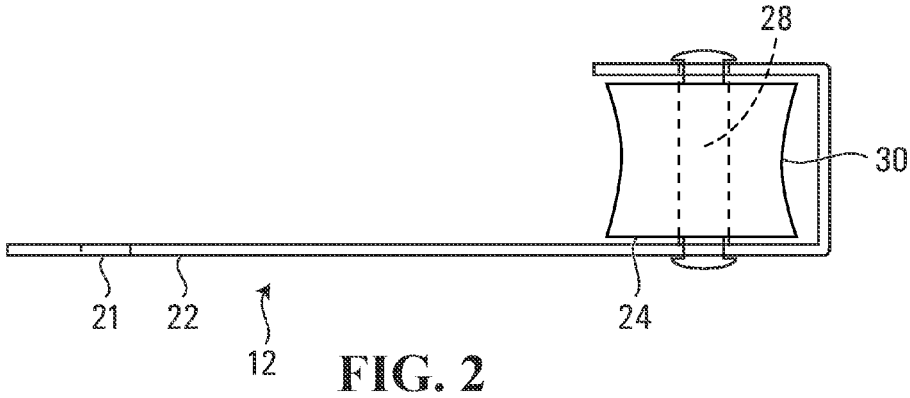
FIG. 2 is an isometric elevational side view of a support line catch of the invention.
Figure 3:
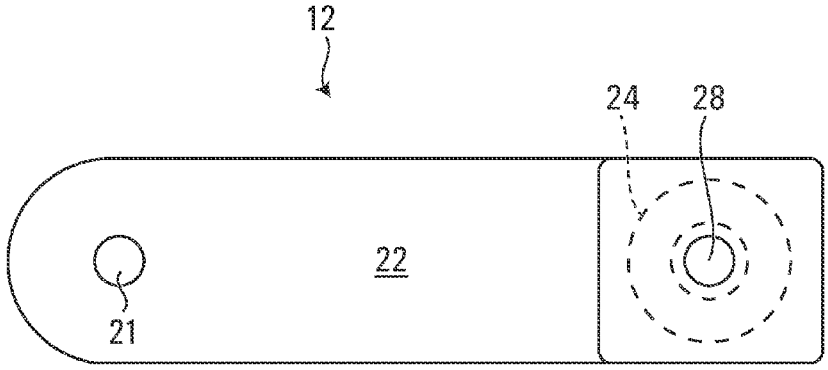
FIG. 3 is an isometric rear plan view of the support line catch of FIG. 2.
Figure 4:
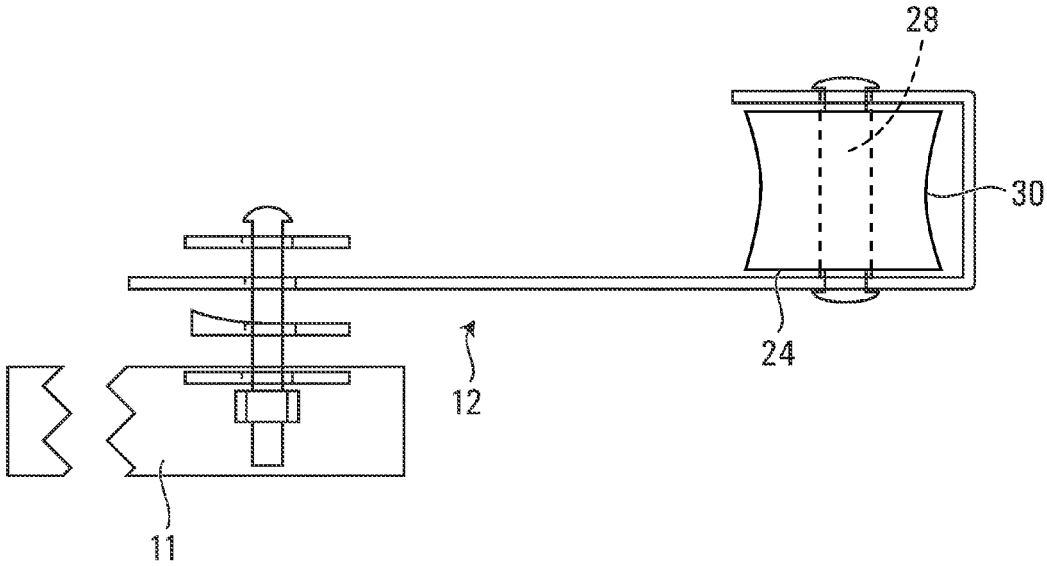
FIG. 4 is an isometric elevational side view of an embodiment of the support line catch of FIG. 2 showing the support line catch in association with a mounting.
Figure 5:
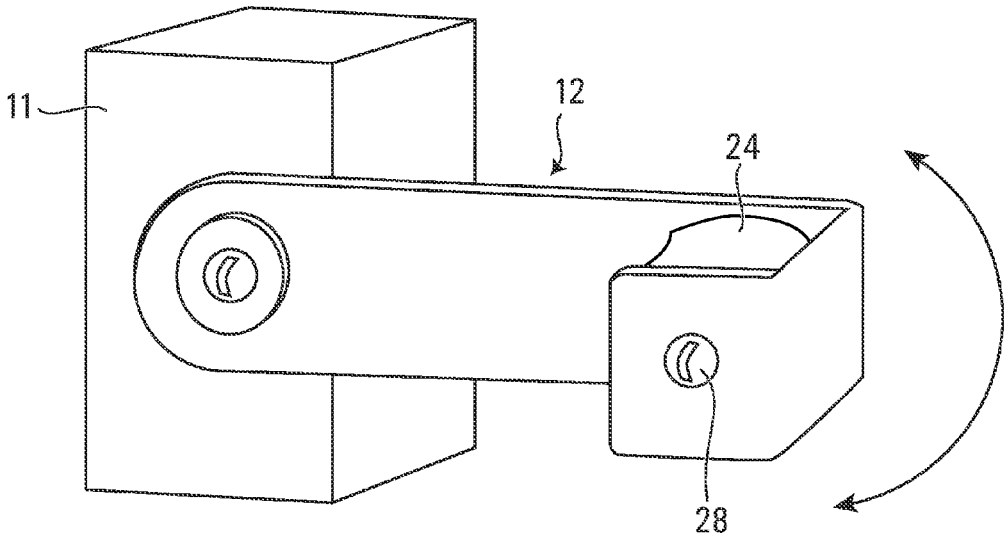
FIG. 5 is a perspective view of the embodiment of FIG. 4.

As shown in FIGS. 2 and 3, support line catches may be comprised of a mounting bracket 22 supporting a pulley 24 spaced apart from a mounting pin aperture 21. Pulley 24 may be made up of a pulley wheel 26 mounted on pulley axel 28, with a circumferential pulley wheel groove 30 that locates support line 18 on pulley 24. Mounting pin aperture 21 facilitates pivotal attachment of support line catch 12 to container 11.

Catches 12 removably engage support line 18, to hold support line 18 and signage sheet 10 on container 11 when support line 18 is in a tensioned state, and so that catches 12 release support line 18 and signage sheet 10 from container 11 when support line 18 is in an untensioned state. The number and position of support line catches 12 will determine the range of mounting positions available for the signage sheet.

Figure 6:
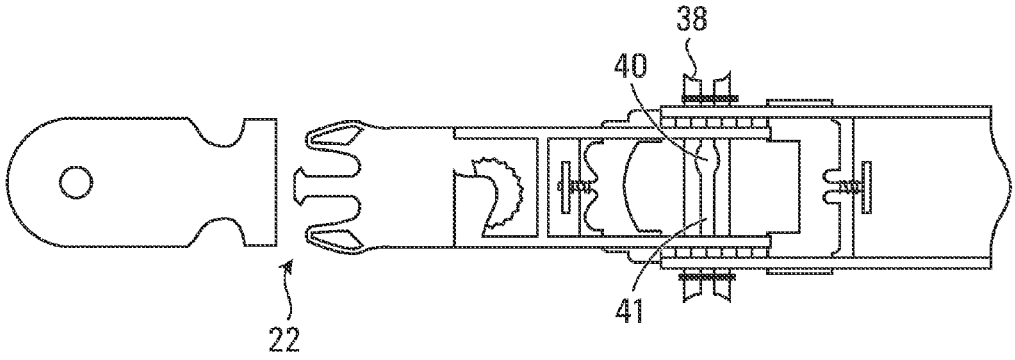
FIG. 6 is an isometric front view of a ratchet winch support line tensioning mechanism.
Figure 7:
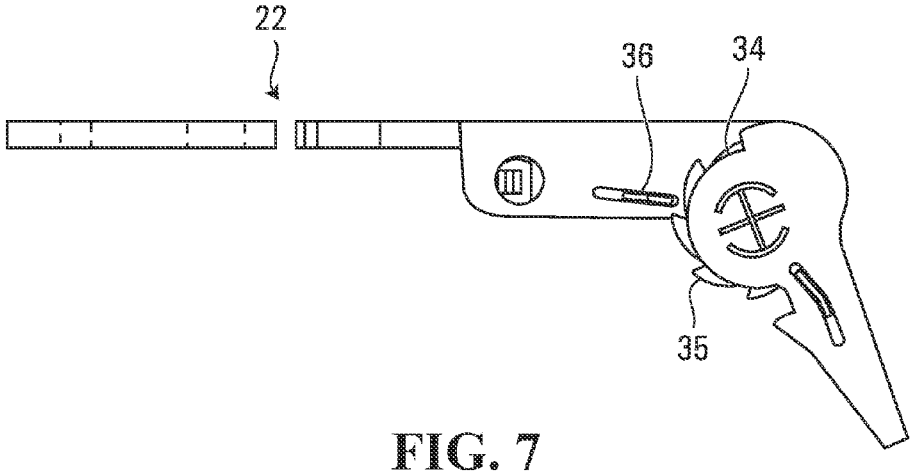
FIG. 7 is an elevational side view of the ratchet winch support line tensioning mechanism of FIG. 6.
Figure 8:
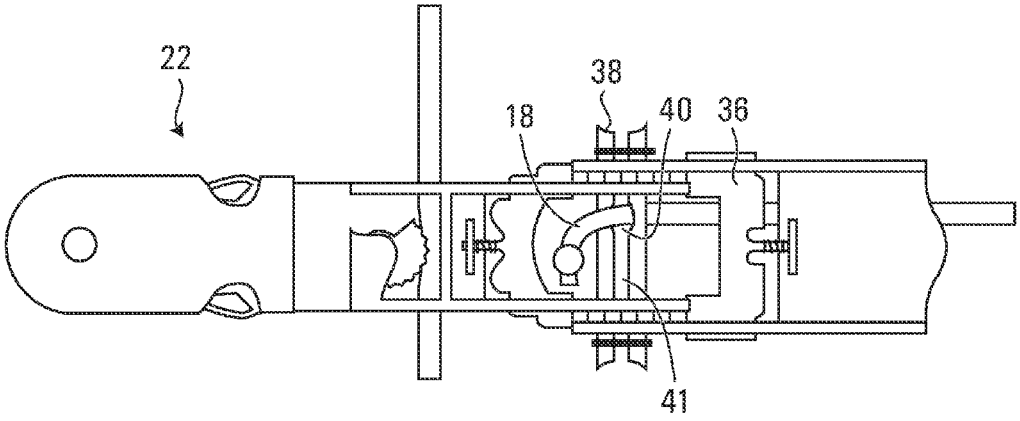
FIG. 8 is an isometric front view of the ratchet winch support line tensioning mechanism of FIG. 6 in association with vertical and horizontal cables.
Figure 9:
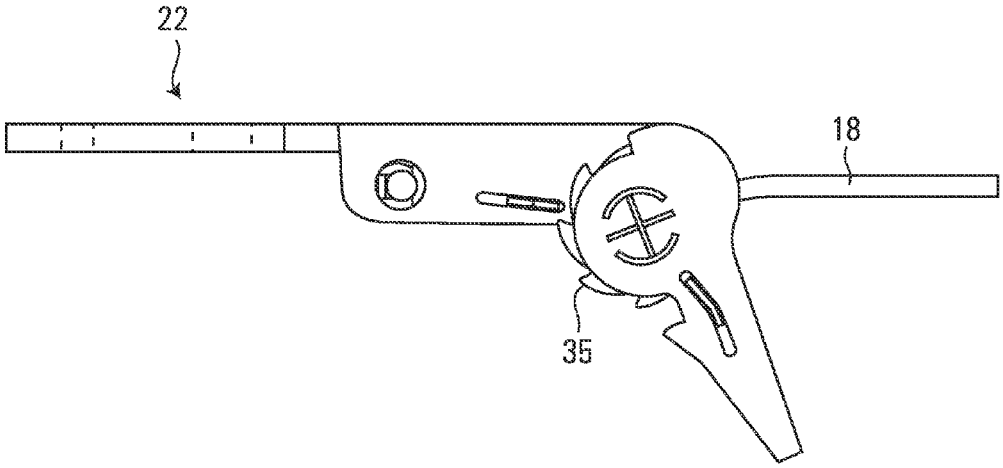
FIG. 9 is an elevational side view of the ratchet winch support line tensioning mechanism of FIG. 8 in association with both vertical and horizontal cables.
Figure 10:
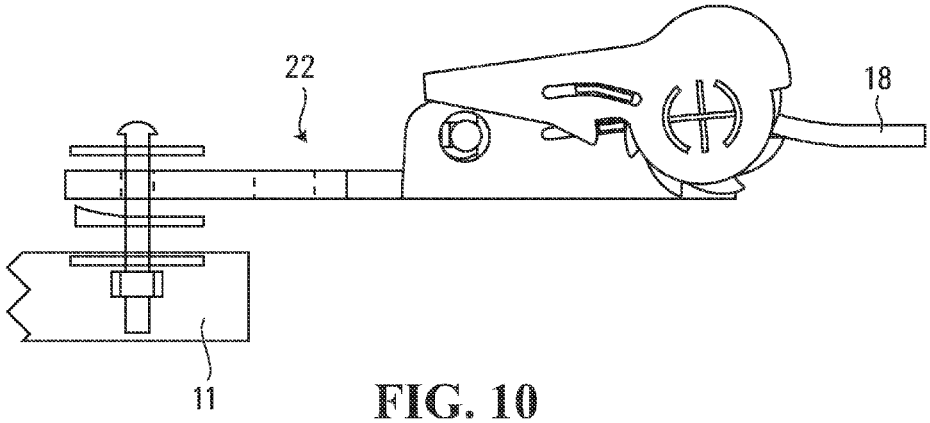
FIG. 10 is an isometric elevational side view of the ratchet winch support line tensioning mechanism of FIG. 6 in association with vertical and horizontal cables.
Figure 11:
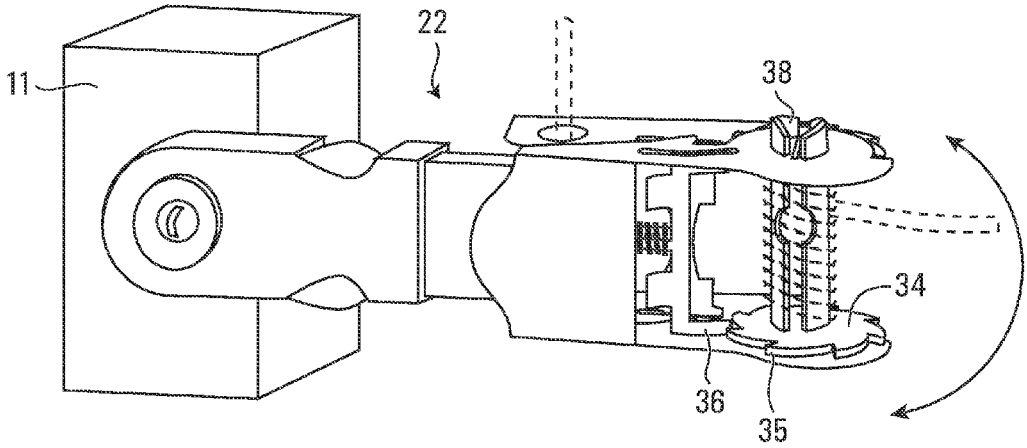
FIG. 11 is a perspective view of the ratchet winch support line tensioning mechanism of FIG. 6 in association with vertical and horizontal cables.

Support line length adjustment mechanism 22, is illustrated in a ratchet winch embodiment in FIGS. 6 and 7. Ratchet winch 22 has a gearwheel 34 with teeth 35 set off at an angle to engage pawl 36. Support line length adjustment mechanism 22 is adapted to be actuated to alternatively shorten or lengthen support line 18. Shortening support line 18 in engagement with catches 12, tensions support line 18 on catches 12, to fix support line 18 on catches 12. Lengthening support line 18 releases the tension on the support line, so that the support line is in an un-tensioned state, eventually releasing the support line from engagement with the catches.

Support line length adjustment mechanism 22 may have a fixed attachment to a first end of support line 18, and a releasable attachment to a second end of the support line. In this way, a mechanical failure of the system, for example breakage of one of the catches, does not allow support line 18 to fall off a moving container 11. Ratchet winch 22 may releasably engage support line 18 at alternative points along the length of support line 18, to provide even greater flexibility in arranging the length of support line 18. For example, balls or sleeves may be swaged along the length of a support line cable, forming tits that engage cable yoke 38, the support line tits being sized to pass through yoke aperture 40, but not through yoke body 41.

In some embodiments, a counter (not shown) may be used to record one or more aspects of the usage of support line tensioning mechanism 22, such as the number of actuations of support line length adjustment mechanism 22. In this way, the counter provides a mechanism for determining the frequency or extent of use of the support line tensioning mechanism 22. This may be desirable, for example, to provide an indication that the signage 10 has in fact been used during an extended container trip during which the necessary usage of container doors 16 should entail a predictable degree of tensioning mechanism usage. In the event that the counter suggests that the tensioning mechanism has not been used to the extent that is expected, this may provide an indication that the signage has been stored instead of displayed for at least part of the trip.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

The invention claimed is:

1. A signage mounting system comprising:

a) a movable container, having an interior and an exterior, adapted to house material in the interior of the container for transport, the container having an access door that is openable to provide an opening into the interior of the container to admit the material, the door being closable for transport of the container, so that the door has an open position and a closed position;

b) a flexible signage sheet removably mounted on the exterior of the container covering an external container surface, so that the signage sheet has an interior sheet surface facing the external container surface and an opposing exterior sheet surface facing away from the external container surface, the exterior surface of the signage sheet bearing visible symbols;

c) a variable length tensionable support line, perimetrically attached to the signage sheet, drawing the signage sheet flat over the external container surface;

d) a plurality of support line catches attached to the container, the catches removably engaging the support line, so as to hold the support line and the signage sheet on the container when the support line is in a tensioned state, and so that the catches release the support line and the signage sheet from the container when the support line is in an untensioned state;

e) a support line length adjustment mechanism adapted to be actuated to alternatively:

i) shorten and thereby tension the support line on the catches, so that the support line is in the tensioned state fixing the support line on the catches, and ii) lengthen and thereby untension the support line on the catches, so that the support line is in the untensioned state releasing the support line from engagement with the catches; and, f) wherein the support line length adjustment mechanism has a fixed attachment to a first end of the support line and a releasable attachment to a second end of the support line.

2. The signage mounting system of claim 1, wherein the signage sheet is generally flat and planar when removably mounted on the exterior of the container, so that the signage sheet is in juxtaposed parallel planar arrangement with, and covering, the external container surface.

3. The signage mounting system of claim 1, wherein the variable length tensionable support line is slidably attached to the signage sheet.

4. The signage mounting system of claim 1, wherein the support line length adjustment mechanism is attached to the container and attached to the support line.

5. The signage mounting system of claim 1 wherein the support line is removably attached to the signage sheet.

6. The signage mounting system of claim 1 wherein the external container surface covered by the signage sheet includes an area on the access door that overlaps at least a portion of the opening when the door is in open position.

7. The signage mounting system of claim 1 wherein the signage sheet is located on the container so as to prevent the door from being moved to the open position when the signage sheet is mounted on the container.

8. The signage mounting system of claim 1 wherein the support line length adjustment mechanism is a ratchet winch that is actuated to alternatively draw in the support line, and thereby to tension the support line, or to pay out the support line, and thereby to untension the support line.

9. The signage mounting system of claim 1 wherein the door is mounted on hinges, at least one of the hinges having a hinge plate, and at least one support line catch is mounted to the hinge plate.

10. The signage mounting system of claim 1 at least one of the support line catches being pivotally mounted to the container, to form an elongate pivoting catch having a fixed end pivotally mounted on the container and a distal end swinging about the fixed end, the pivoting catch being thereby movable throughout an arc on a plane that is generally coplanar with the signage sheet.

11. The signage mounting system of claim 10, wherein a plurality of the catches are elongate pivoting catches, and there are at least two alternative configurations of engagement for the support line with the catches, a first configuration of engagement in which the support line engages a selected pivoting catch, and a second configuration of engagement in which the selected pivoting catch does not engage the support line and the pivoting catch swings out of the way to permit mounting of the support line on the remaining catches.

12. The signage mounting system of claim 1 wherein the support line catch comprises a pulley having a pulley wheel with a circumferential pulley wheel groove that locates the support line on the pulley.

13. The signage mounting system of claim 1 further comprising a support line length adjustment counter, which records actuations of the support line length adjustment mechanism.

14. The signage mounting system of claim 1 wherein the catches are magnetically attached to the container.

15. The signage mounting system of claim 1 wherein the support line is a wire rope.

16. The signage mounting system of claim 1 wherein the support line comprises balls or sleeves swaged along the length of the support line, and the support line length adjustment mechanism comprises a yoke that engages the balls or sleeves.

17. The signage mounting system of claim 1 wherein hinge plates are fastened to the movable container, and at least one support line catch is mounted to the hinge plate.

* * * * *